US011639776B2

(12) United States Patent
Agro et al.

(10) Patent No.: US 11,639,776 B2
(45) **Date of Patent: *May 2, 2023**

(54) LUMINAIRE

(71) Applicant: Molex, LLC, Lisle, IL (US)

(72) Inventors: James V. Agro, Geneva, IL (US); Christopher Blount, Naperville, IL (US); Giovanni Frezza, Buffalo Grove, IL (US); Michael C. Picini, Aurora, IL (US); Victor Zaderej, Wheaton, IL (US); Marko Spiegel, La Fox, IL (US)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/555,504

(22) Filed: Dec. 20, 2021

(65) Prior Publication Data

US 2022/0163172 A1 May 26, 2022

Related U.S. Application Data

(63) Continuation of application No. 15/998,625, filed as application No. PCT/US2017/017908 on Feb. 15, 2017, now Pat. No. 11,221,111, which is a continuation of application No. PCT/US2017/017885, filed on Feb. 15, 2017.

(60) Provisional application No. 62/459,124, filed on Feb. 15, 2017, provisional application No. 62/362,352, filed on Jul. 14, 2016, provisional application No.

(Continued)

(51) Int. Cl.

| | |
|---|---|
| ***F21K 9/68*** | (2016.01) |
| ***F21K 9/65*** | (2016.01) |
| ***F21V 23/04*** | (2006.01) |
| ***H05B 45/22*** | (2020.01) |
| ***H05B 45/28*** | (2020.01) |
| *F21Y 115/10* | (2016.01) |

(52) U.S. Cl.

CPC ..... *F21K 9/68* (2016.08); *F21K 9/65* (2016.08); *F21V 23/0464* (2013.01); *F21V 23/0471* (2013.01); *H05B 45/22* (2020.01); *H05B 45/28* (2020.01); *F21Y 2115/10* (2016.08)

(58) Field of Classification Search

CPC .. F21S 8/026; F21V 23/0464; F21V 23/0471; F21K 9/68; F21K 9/65

See application file for complete search history.

(56) References Cited

U.S. PATENT DOCUMENTS

| | | | |
|---|---|---|---|
| 5,991,172 | A | 11/1999 | Jovanovic et al. |
| 7,373,528 | B2 | 5/2008 | Schindler |

(Continued)

FOREIGN PATENT DOCUMENTS

| | | | |
|---|---|---|---|
| CN | 101826970 | A | 9/2010 |
| CN | 201639593 | U | 11/2010 |

(Continued)

OTHER PUBLICATIONS

Office Action received for U.S. Appl. No. 16/081,781, dated Jun. 2, 2022, 22 pages.

(Continued)

*Primary Examiner* — Karabi Guharay

(57) ABSTRACT

A luminaire with a removable rail is disclosed. The luminaire can be powered with power provided by a power over Ethernet (PoE) solution. The rail can include a sensor that can provide feedback to the luminaire. The sensor can detect ambient information. A controller can modify output of the luminaire based on sensed information.

13 Claims, 28 Drawing Sheets

Related U.S. Application Data

62/303,223, filed on Mar. 3, 2016, provisional application No. 62/295,400, filed on Feb. 15, 2016.

(56) References Cited

U.S. PATENT DOCUMENTS

| | | | |
|---|---|---|---|
| 7,587,289 | B1 | 9/2009 | Sivertsen |
| 8,345,428 | B2 | 1/2013 | Nielsen et al. |
| 8,352,769 | B1 | 1/2013 | Ghose et al. |
| 8,523,383 | B1 | 9/2013 | Grigore et al. |
| 9,155,111 | B2 | 10/2015 | Wang et al. |
| 9,155,171 | B1 | 10/2015 | Hughes et al. |
| 9,295,142 | B1 | 3/2016 | Leinen et al. |
| 2003/0167345 | A1 | 9/2003 | Knight et al. |
| 2004/0164619 | A1 | 8/2004 | Parker et al. |
| 2005/0289274 | A1 | 12/2005 | Ghercioiu et al. |
| 2007/0074052 | A1 | 3/2007 | Hemmah et al. |
| 2007/0263333 | A1 | 11/2007 | Apfel |
| 2009/0063874 | A1 | 3/2009 | Diab |
| 2010/0031070 | A1 | 2/2010 | Tomomitsu |
| 2010/0049994 | A1 | 2/2010 | Ghoshal |
| 2010/0315821 | A1 | 12/2010 | Weber et al. |
| 2011/0077793 | A1 | 3/2011 | Hsieh et al. |
| 2011/0298428 | A1 | 12/2011 | Liu |
| 2012/0084400 | A1 | 4/2012 | Almadi et al. |
| 2012/0131372 | A1 | 5/2012 | Hibi |
| 2012/0254475 | A1 | 10/2012 | Voss et al. |
| 2012/0271477 | A1 | 10/2012 | Okubo et al. |
| 2012/0293999 | A1 | 11/2012 | Chung et al. |
| 2012/0299728 | A1 | 11/2012 | Kirkpatrick et al. |
| 2013/0117581 | A1 | 5/2013 | Katkade et al. |
| 2013/0170210 | A1 | 7/2013 | Athalye |
| 2013/0187457 | A1 | 7/2013 | Schlichter et al. |
| 2013/0339760 | A1 | 12/2013 | Zimmerman et al. |
| 2013/0342688 | A1 | 12/2013 | Siu |
| 2014/0005809 | A1 | 1/2014 | Frei et al. |
| 2014/0005909 | A1 | 1/2014 | Meisner et al. |
| 2014/0040641 | A1 | 2/2014 | Diab |
| 2014/0098842 | A1 | 4/2014 | White, III et al. |
| 2014/0135644 | A1 | 5/2014 | Kim |
| 2014/0208140 | A1 | 7/2014 | Brooks et al. |
| 2014/0245031 | A1 | 8/2014 | Hamdi et al. |
| 2014/0354161 | A1 | 12/2014 | Aggarwal et al. |
| 2014/0369687 | A1 | 12/2014 | Jain |
| 2015/0022096 | A1 | 1/2015 | Deixler |
| 2015/0084547 | A1 | 3/2015 | Yeh et al. |
| 2015/0091723 | A1 | 4/2015 | Fiedler et al. |
| 2015/0127957 | A1 | 5/2015 | Sethi |
| 2015/0195883 | A1 | 7/2015 | Harris et al. |
| 2015/0256355 | A1 | 9/2015 | Pera et al. |
| 2015/0295732 | A1 | 10/2015 | Lai |
| 2015/0331464 | A1 | 11/2015 | Balasubramanian et al. |
| 2016/0020910 | A1 | 1/2016 | Jones et al. |
| 2016/0036268 | A1 | 2/2016 | Laherty et al. |
| 2016/0037613 | A1 | 2/2016 | Laherty et al. |
| 2016/0064938 | A1 | 3/2016 | Balasubramanian et al. |
| 2016/0094350 | A1 | 3/2016 | Picard |
| 2016/0134332 | A1 | 5/2016 | Lai |
| 2016/0138789 | A1 | 5/2016 | Brown |
| 2016/0157318 | A1 | 6/2016 | Yadav et al. |
| 2016/0227630 | A1 | 8/2016 | Wendt et al. |
| 2016/0273722 | A1 | 9/2016 | Crenshaw |
| 2016/0286619 | A1 | 9/2016 | Roberts et al. |
| 2016/0309561 | A1 | 10/2016 | Hamilton et al. |
| 2016/0337137 | A1 | 11/2016 | Yseboodt et al. |
| 2017/0010645 | A1 | 1/2017 | Jain et al. |
| 2017/0039630 | A1 | 2/2017 | Daigle et al. |
| 2017/0068307 | A1 | 3/2017 | Vavilala et al. |
| 2017/0109373 | A1 | 4/2017 | Sung et al. |
| 2017/0111976 | A1 | 4/2017 | Van Endert |
| 2017/0118030 | A1 | 4/2017 | Love |
| 2017/0234495 | A1 | 8/2017 | Zaderej et al. |
| 2017/0237580 | A1 | 8/2017 | Radermacher et al. |
| 2017/0238401 | A1 | 8/2017 | Sadwick et al. |
| 2017/0366342 | A1 | 12/2017 | Gehrmann |
| 2018/0035505 | A1 | 2/2018 | Foster et al. |
| 2018/0048485 | A1 | 2/2018 | Pelton et al. |
| 2018/0098201 | A1 | 4/2018 | Torello et al. |
| 2019/0166088 | A1 | 5/2019 | Krochik et al. |
| 2019/0280895 | A1 | 9/2019 | Mather et al. |

FOREIGN PATENT DOCUMENTS

| | | | |
|---|---|---|---|
| CN | 201797312 | U | 4/2011 |
| CN | 102223707 | A | 10/2011 |
| CN | 102299807 | A | 12/2011 |
| CN | 102918798 | A | 2/2013 |
| CN | 103067183 | A | 4/2013 |
| CN | 104520636 | A | 4/2015 |
| CN | 204993396 | U | 1/2016 |
| CN | 105379044 | A | 3/2016 |
| CN | 205545307 | U | 8/2016 |
| CN | 205827577 | U | 12/2016 |
| WO | 2011055284 | A2 | 5/2011 |
| WO | 2017142907 | A1 | 8/2017 |

OTHER PUBLICATIONS

Final Rejection received for U.S. Appl. No. 16/486,234, dated Mar. 3, 2021, 19 Pages.

Final Rejection received for U.S. Appl. No. 16/081,781, dated May 19, 2021, 21 Pages.

International Preliminary Report on Patentability received for PCT Application No. PCT/US2017/017885 dated Sep. 13, 2018, 11 Pages.

International Preliminary Report on Patentability received for PCT Application No. PCT/US2017/017908 dated Aug. 30, 2018, 9 Pages.

International Preliminary Report on Patentability received for PCT Application No. PCT/US2018/018349 dated Aug. 29, 2019, 12 Pages.

International Search Report and Written Opinion received for PCT Application No. PCT/US2017/017885, dated May 17, 2017, 12 Pages.

International Search Report and Written Opinion received for PCT Application No. PCT/US2017/017908, dated May 26, 2017, 11 Pages.

International Search Report and Written Opinion received for PCT Application No. PCT/US2018/018349, dated Jun. 4, 2018, 13 Pages.

Non Final Rejection received for U.S. Appl. No. 16/081,781, dated Dec. 7, 2020, 18 Pages.

Non Final Rejection received for U.S. Appl. No. 16/486,234, dated Nov. 10, 2020, 17 Pages.

Non-Final Rejection received for U.S. Appl. No. 16/081,781, dated Oct. 15, 2021, 20 Pages.

Office Action received for CN Application No. 201780021117.X, dated Nov. 1, 2019, 15 Pages (08 Pages of English Translation and 07 Pages of Official notification).

Office Action received for CN application No. 201780024943.X, dated Jul. 29, 2020, 19 Pages (10 pages of English translation and 09 pages of official).

Office Action received for CN Application No. 201880024646.X, dated May 24, 2021, 18 Pages (05 Pages of English Translation and 13 Pages of Official notification).

Non-Final Rejection received for U.S. Appl. No. 15/998,625, dated Mar. 1, 2021, 07 Pages.

Non-Final Rejection received for U.S. Appl. No. 15/998,625, dated Sep. 2, 2020, 08 Pages.

LUMINAIRE

RELATED APPLICATIONS

This application is a continuation of U.S. application Ser. No. 15/998,625, filed Aug. 15, 2018, now U.S. Pat. No. 11,221,111, which is incorporated herein by reference in its entirety and is a national stage of International Application No. PCT/US2017/017908, filed Feb. 15, 2017, which in turn claims the benefit of the following applications, the entire contents of which are incorporated by reference in their entirety: U.S. Provisional Patent Application "LUMINAIRE" having No. 62/295,400 filed on Feb. 15, 2016, U.S. Provisional Patent Application "POE AUTOMATION CONTROL SYSTEM" having No. 62/303,223 filed on Mar. 3, 2016, U.S. Provisional Patent Application "POE AUTOMATION CONTROL SYSTEM" having No. 62/362,352 filed on Jul. 14, 2016, PCT Patent Application "SYSTEM AND METHOD FOR POWER OVER ETHERNET CONTROL" having international application number PCT/US17/17885 filed on Feb. 15, 2017, and U.S. Provisional Patent Application "SYSTEM AND METHOD FOR BEACON" having No. 62/459,124 filed on Feb. 15, 2017.

TECHNICAL FIELD

This disclosure relates to field of illumination, more specifically to the field of illumination with a light emitting diode (LED).

DESCRIPTION OF RELATED ART

LEDs as a general illumination sources have become increasingly popular. Recent developments have shown that LEDs can provide an efficient light source, and lab results show that certain LEDs can approach or even exceed 150 lumens/watts. In addition, LEDs avoid the need for using mercury, thus providing a friendlier environmental footprint than other conventional illumination technologies.

While LEDs are useful for illumination, one issue that exists is the expense of installing LED fixtures. One method to address this is to develop LED-based designs that are comparable to existing bulbs. While this can be done, it generally is suboptimal due to the fact that design tradeoffs needed to allow LEDs to function in existing fixtures tend to do a poor job of efficiently using the light provided by LEDs. More optimized fixtures would tend to be more effective at efficiently directing the emitted lumens on the desired surfaces.

In many facilities, a significant portion of the electricity being consumed is directed towards illumination. Even with the substantial increases in efficiency, it is still desirable to minimize the use of the electricity when feasible. By increasing the intelligence of the system, it is expected that further improvements in the efficacy of a building system can be provided.

While use is one portion of the efficiency of a system, another portion of the efficiency is the cost to install and maintain the illumination system. LEDs, due to their long life and gradual decrease in output, are well suited to commercial facilities. Instead of being replaced every 10,000 hours, for example, they can be replaced every 50,000 or more hours. This longevity can substantially increase the ROI as commercial facilities must pay someone to replace bulbs and often the replacement requires positioning someone near a ceiling that is more than 10 feet above the ground (potentially requiring the use of lifts or other means to safely position the person in the appropriate position).

Existing LED fixtures, however, while offering long life, often fail to provide a simple installation process. For improved safety, it would be helpful if the installation process could be done with one hand. It further would be beneficial if the luminaire could be used in a more intelligent manner.

SUMMARY

In an embodiment, a luminaire includes a housing with a reflector. A rail is positioned near the reflector and has a light board thereon which is configured to emit light into the reflector. The light is reflected from the reflector and passes through a diffuser that can act to ensure the emitted light is desirably defuse. In an embodiment, the diffuser can be removed from the housing for service or replacement.

BRIEF DESCRIPTION OF THE DRAWINGS

The present disclosure is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

FIGS. 1-10 illustrate a first embodiment of a luminaire 1020 which incorporates features of the present disclosure. FIGS. 11-31A illustrate a second embodiment of a luminaire 2020 which incorporates features of the present disclosure. The luminaire 1020, 2020 is configured to be mounted in, or suspended from, a ceiling (not shown).

Attention is invited to the luminaire 1020 shown in FIGS. 1-10. The luminaire 1020 includes a housing 1022 with a reflector, provided in this embodiment as a reflection chamber 1024. The housing 1022 is mounted in, or suspended from, the ceiling in a known manner. The depicted reflection chamber 1024 is convex, with a partial circular shape but other shapes may be used as desired and may include angles rather than smooth curves. A pair of diffusers 1026 are provided to help provide a more diffuse lighting source. The housing 1022 supports a rail 1028 and the rail 1028 includes a connector 1030 that is intended to mate with a connector 1032 supported by the housing 1022. The rail 1028 is intended to be removably mated to the housing 1022. In an embodiment, one end of the rail 1028 is secured by the housing 1022 via a tab 1034, see FIG. 5, that supports one end of the rail 1028 while the other end is supported by the connector 1032.

The rail 1028 and the diffusers 1026 are positioned so as to be aligned with the reflection chamber 1024. The rail 1028 has a first side facing the reflection chamber 1024 and the first side supports a light board 1036 that includes a set of LEDs 1038. The LEDs 1038 are thermally coupled to the rail 1028. While two LEDs 1038 are depicted for purposes of clarity, in practice it is expected that 4 or more LEDs (preferably more than 10 LEDs) will be provided so as to provide more even illumination. Thus, the set of LEDs 1038 can have a relatively large number of LEDs if desired. The rail 1028 further includes a second side opposite the first side and a sensor board 1040 (e.g., FIG. 36) can be mounted on the second side. The housing 1022 supports the connector 1032 that is configured to mate with the connector 1030 on the rail 1028. One or both of the connectors 1030, 1032 can include a releasable latch (not shown) that helps hold the connectors 1030, 1032 in a mated condition. A cover 1042 is attached to the rail 1028 to cover the sensor board 1040.

Figure 36:
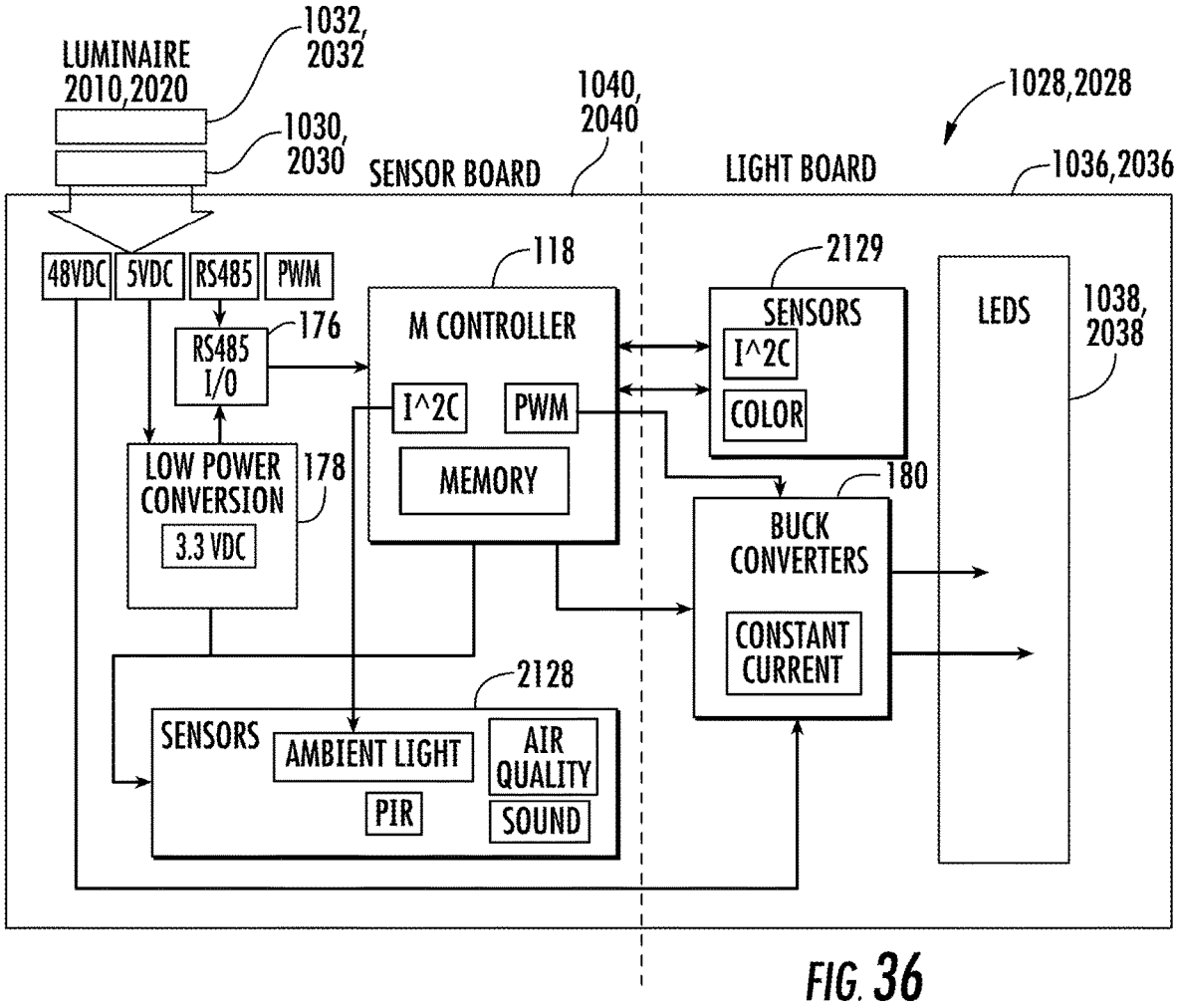
FIG. 36 is an example circuitry for the sensor board and light board.

The LEDs 1038 on the light board 1036 can be controlled by a controller 118 (FIG. 36). The LEDs 1038 will typically include more than two LEDs but there is not a particular number that is required. In some embodiments, the LEDs 1038 may be of differing color temperatures. Such an assortment enables many different lighting color temperatures to be provided by varying the mix and illumination level of different LED colors. The location of the controller 118 that adjusts the output and/or the lighting effects of the LED array can vary depending on the configuration of the luminaire.

In some embodiments, the controller 118 may be mounted on, or integrated into, the sensor board 1040. Naturally such a location is not required, and the controller 118 could also be mounted on another board such as a separate circuit board supported by the rail 1028. In an embodiment where the rail 1028 supports the controller 118, the controller 118 can receive various types of input and provide current to the LEDs 1038, per its configuration, based on the input received. As can be appreciated, such a construction allows the connector 1030 to have relatively few inputs (one pair of power inputs and one pair of signal inputs—and if desired the signal inputs could be multiplexed onto the power inputs) while providing a variety of control outputs. Additional or alternative features of the controller 118 are described with regard to the embodiments of the luminaire 2020 of FIGS. 11-33A.

The sensor board 1040 can include various sensors 2128, such as ambient light, temperature, occupancy, motion, noise, air quality, humidity, acceleration, proximity, magnetism, pressure, motion, flux, CO/CO2, correlated color temperature (CCT), red/green/blue (RGB) light, active or passive infrared (PIR), visual information, e.g., from a camera, audio information, e.g., from a microphone, etc., and other desired sensors 2128. The sensors 2128 can be used to provide feedback to the luminaire 1020 so that the luminaire 1020 can provide a more intelligent illumination. For example, motion/occupancy sensors 2128 can help ensure the luminaire 1020 is either off or operating at a reduced output when no one is in the near vicinity. In addition to providing intelligent illumination, the luminaire 1020 can also provide feedback to individuals within visual or audible range. A pattern of LEDs can be provided on the sensor board 1040 and the controller 118 can turn on LEDs to provide the desired visual cues. Some sort of noise generating device (such a speaker or transducer) can also be provided on the sensor board 1040 to provide audible cues. The sensor board 1040 can be electrically coupled to the connector 1030 so as to be powered thereby.

As can be appreciated, the connectors 1030, 1032 will typically provide at least two power terminals. The power can be provided from an Ethernet cable providing power over Ethernet (PoE) or other desirable input. For example, standard 110V-277V may be used with a power converter such as a LED driver device. The advantage of using a PoE source is that the power source is low voltage, which simplifies the entire design of the luminaire and also makes it simple to provide power (one simply runs a network cable to the location and power is provided).

If PoE is used to power the luminaire 1020 then an RJ45 port 2126 (or other suitable port) can be provided in the luminaire 1020 along with an appropriate driver.

Attention is invited to the luminaire 2020 shown in FIGS. 11-33A. The luminaire 2020 includes a housing 2022 having a junction box 2044 affixed to the housing 2022, a connector 2032 attached to the housing 2022 and a light board diffuser assembly 2046 removably attached to the housing 2022. The light board diffuser assembly 2046 includes a connector 2030 which mates with the connector 2032 in the housing 2022 when the light board diffuser assembly 2046 is assembled with the housing 2022. The housing 2022 is mounted in, or suspended from, the ceiling in a known manner.

In an embodiment, the housing 2022 is formed of a reflector 2024 having an end cap 2048, 2050 at each end 2024*a*, 2024*b* of the reflector 2024, and a bracket 2116 attached to the end cap 2048. The reflector 2024 includes first and second convex sections 2052, 2054 which join together at a central apex 2056. An upper side of the reflector 2024 is provided at 2024*c*; and a lower side of the reflector 2024 is provided at 2024*d*. End cap 2048 attaches to the end 2024*a* of the reflector 2024; end cap 2050 attaches to the end 2024*b* of the reflector 2024. The end caps 2048, 2050 are suitably attached to the reflector 2024, such as by tabs seating within apertures, or by welding. In an embodiment, the tabs are bent after insertion through the apertures to secure the end caps 2048, 2050 to the reflector 2024. Other attachments configured to attach the end caps 2048, 2050 to the reflector 2024 are within the scope of the present disclosure. While the first and second sections 2052, 2054 are shown as convex, other shapes may be used as desired and may include angles rather than smooth curves. The end cap 2050 includes a slot 2058 therethrough, see FIG. 13. The bracket 2116 is attached to the end cap 2048 by suitable means, such as rivets. The bracket 2116 extends from the end cap 2048 toward the convex sections 2052, 2054. In an embodiment, the bracket 2116 has an aperture 2117 therethrough.

The connector 2032 houses a plurality of pins or sockets. The connector 2032 is attached to the bracket 2116. In an embodiment, the connector 2032 extends through the aperture 2117 in the bracket 2116.

Figures 14A, 14B:
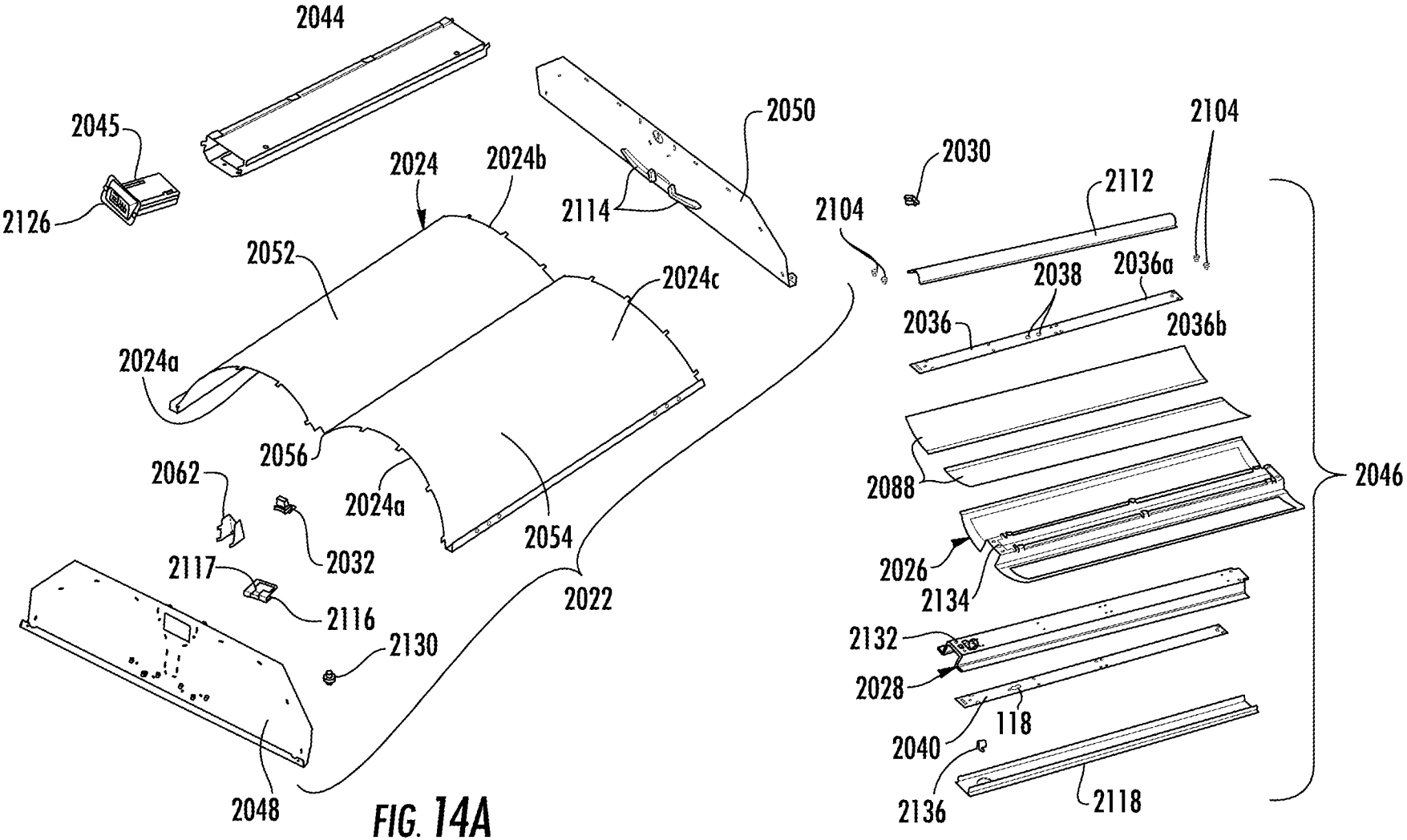
FIG. 14A is a partial exploded top perspective view of the luminaire of FIG. 11.
FIG. 14B is another partial exploded perspective view of the luminaire of FIG. 11.
Figure 15:
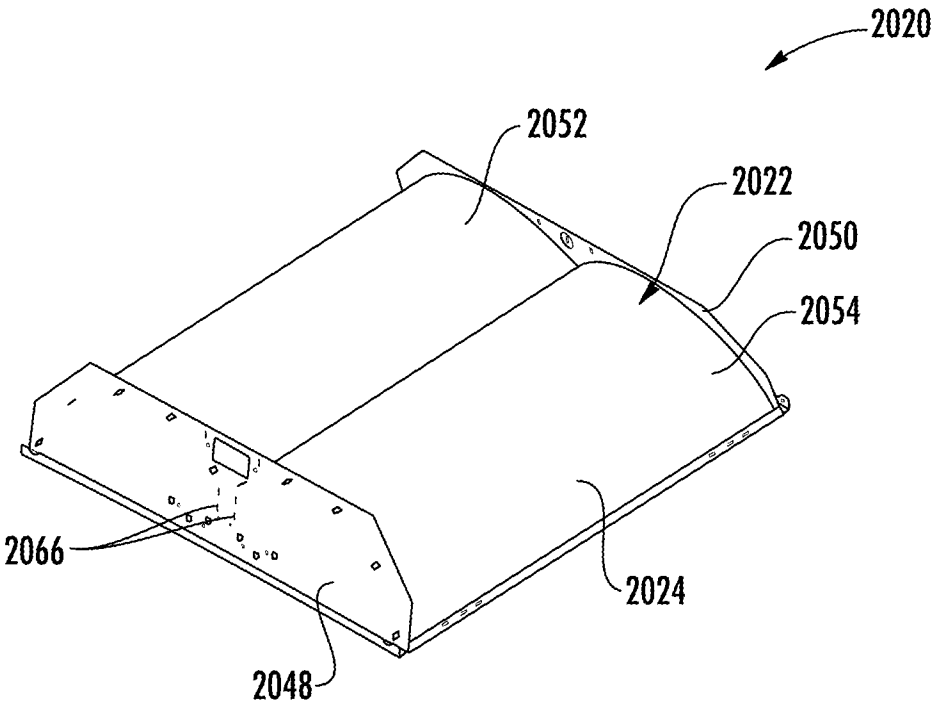
FIG. 15 is a partial top perspective view of a housing of the luminaire of FIG. 11.
Figure 16:
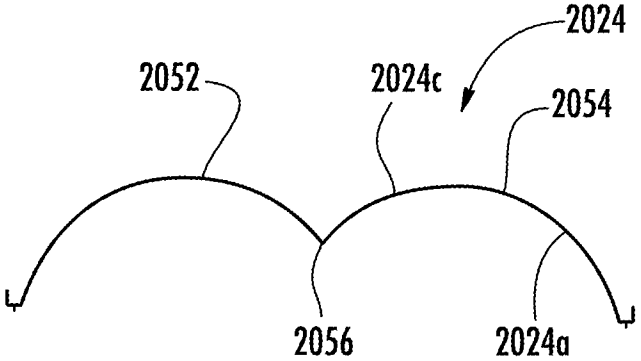
FIG. 16 is an end elevation view of a reflector of the luminaire of FIG. 11.

The connector 2032 seats within a cover 2062, see FIG. 14A, which is, in turn, is attached to the end cap 2048. The cover 2062 is attached to the end cap 2048 by a plurality of tabs 2066 that extend through apertures in the end cap 2048, see FIG. 15. Other attachments configured to attach the cover 2062 to the end cap 2048 are within the scope of the present disclosure. The bracket 2116 is provided below the cover 2062.

The junction box 2044 houses a gateway controller 2045 (FIG. 35) and any other electrical components needed for connecting the luminaire 2020 (luminaire 1020) to a PoE source as discussed herein. In an embodiment, the junction box 2044 is provided above the upper side 2024*c* of the reflector 2024 and attached to the end caps 2048, 2050 by suitable attachments, such as by tabs in apertures or by welding. In an embodiment, the junction box 2044 is spaced from the first and second convex sections 2052, 2054. In an embodiment, the junction box 2044 seats on top of the first and second convex sections 2052, 2054. In an embodiment, the junction box 2044 is attached to a side of the reflector 2024 and to the end caps 2048, 2050 by suitable attachments, such as by tabs in apertures or by welding.

The light board diffuser assembly 2046 is removably attached to the housing 2022 and to the connector 2032. The light board diffuser assembly 2046 includes a diffuser 2026, a rail 2028, a light board 2036 mounted on the rail 2028, the connector 2030 mounted on the light board 2036, a sensor board 2040 mounted on the rail 2028, and attachments 2104 for attaching the diffuser 2026 to the rail 2028. The rail 2028, the connector 2030, the light board 2036 and the sensor board 2040 form a subassembly 2060 of the light board diffuser assembly 2046. The sensors 2128 of the sensor board 2040 (sensor board 1040) can include, but are not limited to, any of the sensors described herein.

Figure 21:
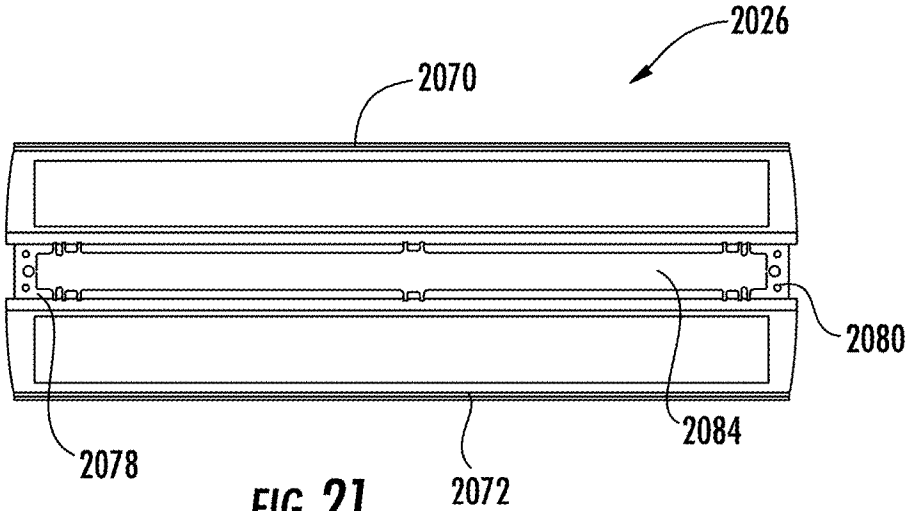
FIG. 21 is a top plan view of the diffuser of FIG. 19.
Figure 19:
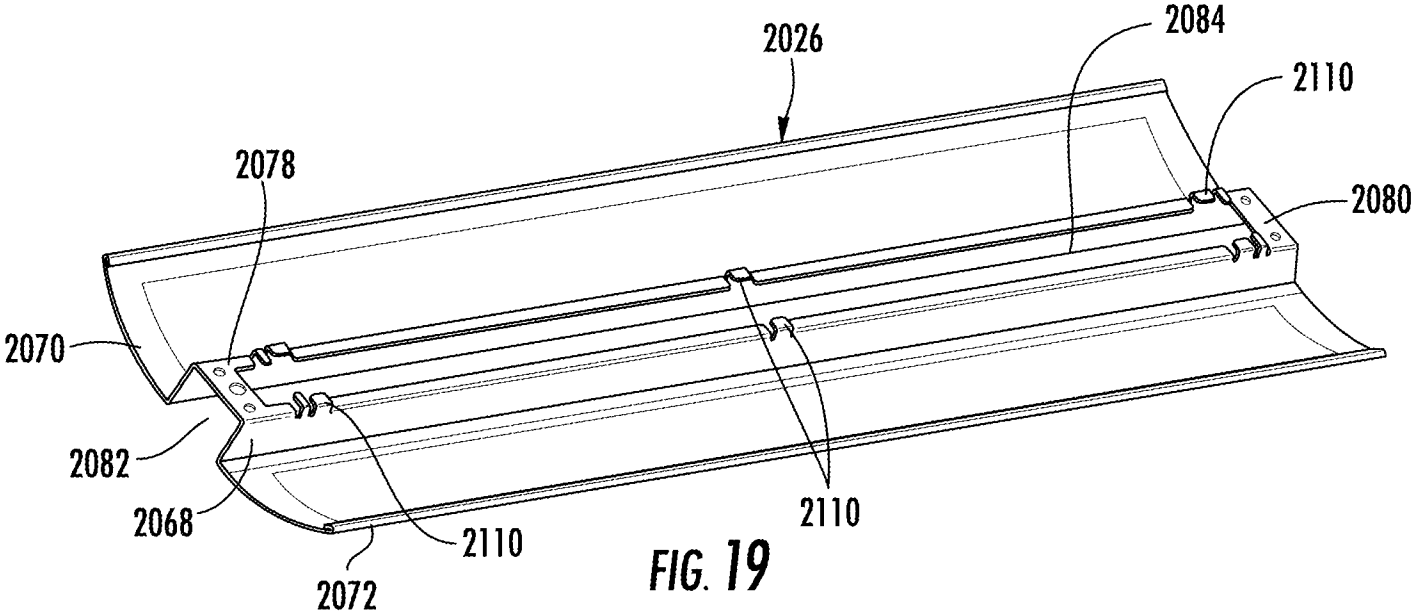
FIG. 19 is a top perspective view of a diffuser of the light board diffuser assembly of FIG. 17.
Figure 20:
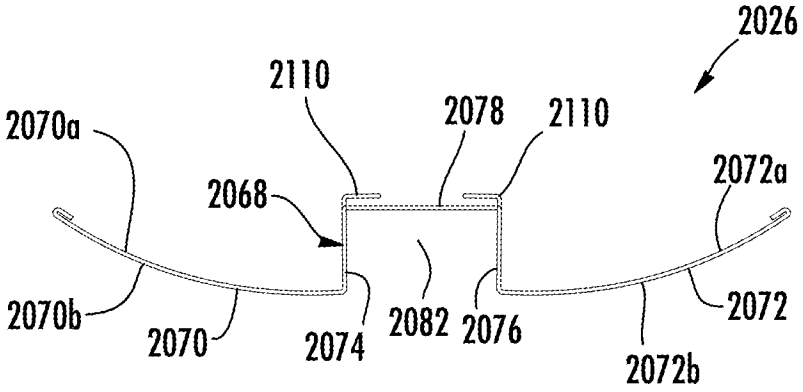
FIG. 20 is an end elevation view of the diffuser of FIG. 19.

As best shown in FIGS. 19-21, the diffuser 2026 includes a central section 2068, a first side section 2070 extending from one side of the central section 2068, and a second side section 2072 extending from the other side of the central section 2068. In an embodiment, the central section 2068 is formed of a first upright wall 2074, a second upright wall 2076 and a top wall formed by a pair of top wall sections 2078, 2080 extending between the upper ends of the upright walls 2074, 2076 such that a cavity 2082 is formed by the central section 2068 and a central aperture 2084 is formed by the upper ends of the upright walls 2074, 2076 and the top wall sections 2078, 2080. In an embodiment, the upright walls 2074, 2076 and the top wall sections 2078, 2080 are planar. The first side section 2070 extends outwardly from the lower end of the first upright wall 2074; the second side section 2072 extends outwardly from the lower end of the second upright wall 2076. In an embodiment, the side sections 2070, 2072 are curved such that each side section 2070, 2072 curves upwardly from the lower ends of the upright walls 2074, 2076. Side section 2070 has an upper surface 2070*a* and a lower surface 2070*b*; side section 2072 has an upper surface 2072*a* and a lower surface 2072*b*. In an embodiment, the side sections 2070, 2072 have a series of perforations 2086 which extend from the upper surfaces 2070*a*, 2072*a* to the lower surfaces 2070*b*, 2072*b*. As shown in FIGS. 30A-34B, the perforations 2086 may take a variety of patterns.

In an embodiment, a film 2088 covers the perforations 2086 in the side sections 2070, 2072 of the diffuser 2026 and assists in diffusing the light generated by the LEDs 2038 through the perforations 2086. In an embodiment, the film 2088 is provided on the upper surface 2070*a*, 2072*a* of the side sections 2070, 2072. The film 2088 on the diffuser 2026 may be omitted.

Figure 22:
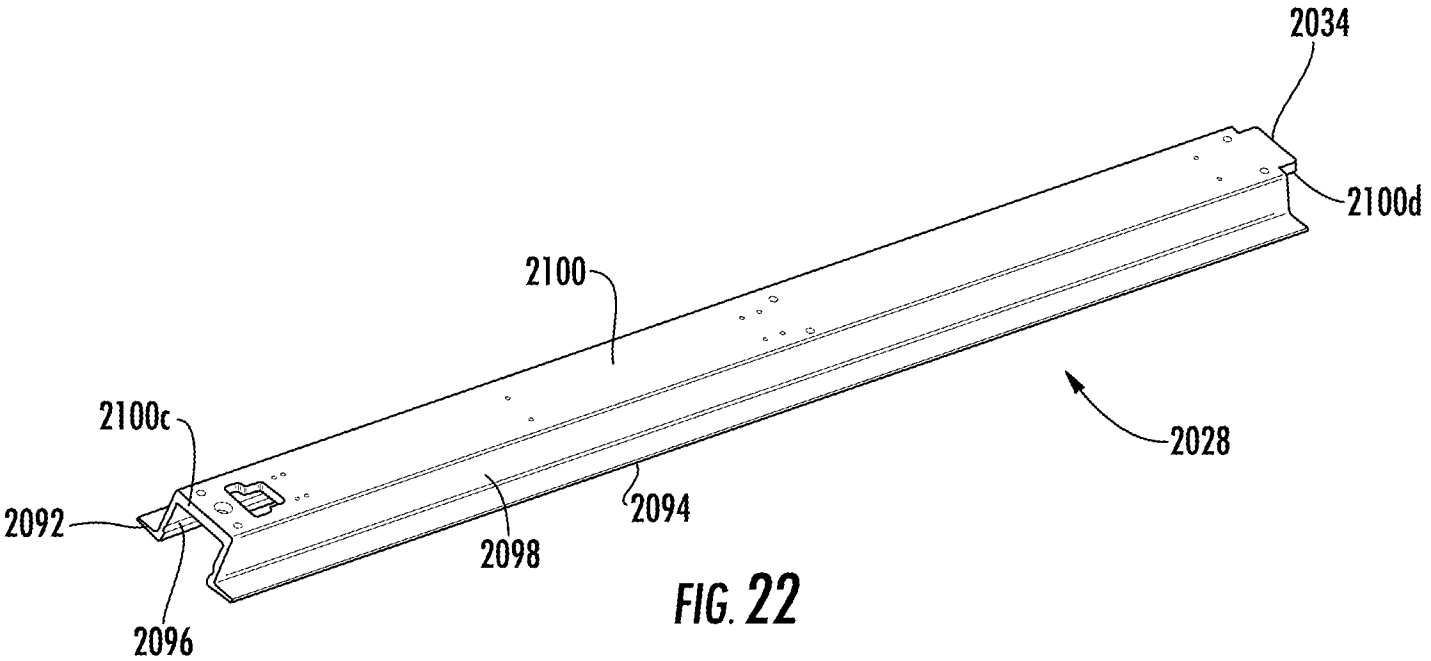
FIG. 22 is a top perspective view of a rail of the light board diffuser assembly of FIG. 17.
Figure 23:
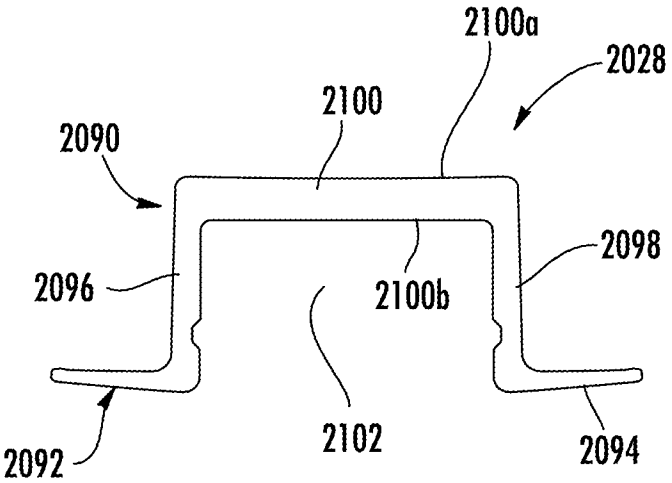
FIG. 23 is an end elevation view of the rail of FIG. 22.
Figure 24:
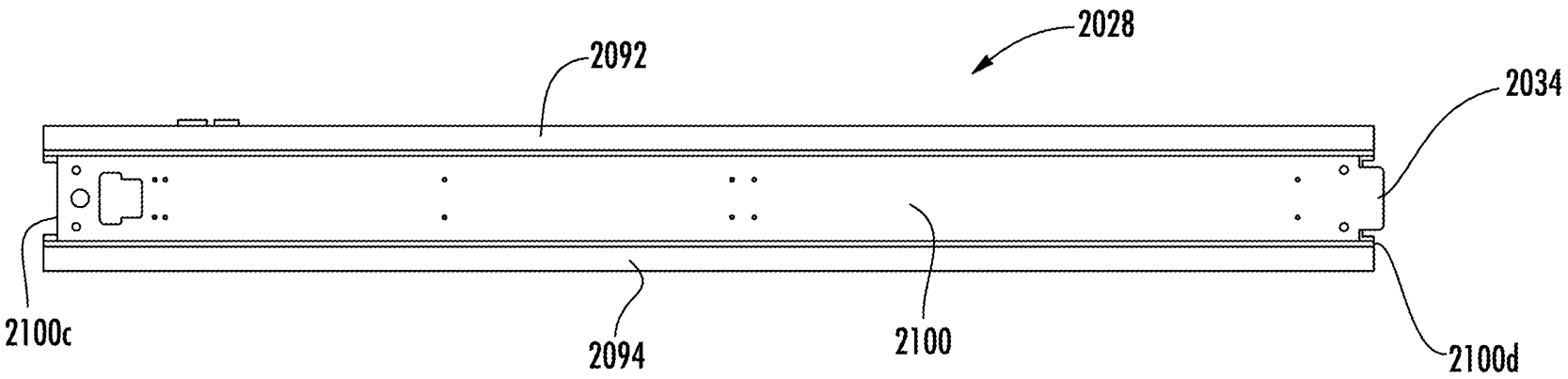
FIG. 24 is a top plan view of the rail of FIG. 22.

As best shown in FIGS. 22-24, the rail 2028 includes a central section 2090, a first side section 2092 extending from one side of the central section 2090, and a second side section 2094 extending from the other side of the central section 2090. In an embodiment, the central section 2090 is formed of a first upright wall 2096, a second upright wall 2098 and a top wall 2100 extending between the upper ends of the upright walls 2096, 2098 such that a cavity 2102 is formed by the central section 2090. The top wall 2100 has an upper surface 2100*a*, a lower surface 2100*b*, and opposite ends 2100*c*, 2100*d*. In an embodiment, the upright walls 2096, 2098 and the top wall 2100 are planar. The side sections 2092, 2094 extend from the bottom ends of the respective walls 2096, 2098 and may curve upwardly relative thereto. A tab 2034 extends outwardly from the top wall 2100 at the end 2100*d* thereof. The tab 2034 has a reduced width relative to the top wall 2100.

The light board 2036 has an upper surface 2036*a* and a lower surface 2036*b*. The light board 2036 is mounted on the rail 2028, such that the lower surface 2036*b* of the light board 2036 abuts against the upper surface 2100*a* of the top wall 2100 of the rail 2028. The light board 2036 may be mounted on the rail 2028 by an adhesive pad or by fasteners (not shown), or by a combination thereof. In an embodiment, the adhesive pad is a thermal tape to provide for heat transfer from the light board 2036 to the rail 2028 which acts as a heat sink. The upper surface 2036*a* of the light board 2036 includes a set of LEDs 2038 (e.g. FIG. 36) which are thermally coupled to the rail 2028. While two LEDs 2038 are depicted for purposes of clarity, in practice it is expected that 4 or more LEDs (preferably more than 10 LEDs) will be provided so as to provide more even illumination. Thus, the set of LEDs 2038 can have a relatively large number of LEDs if desired.

The connector 2030 of the light board diffuser assembly 2046 houses a plurality of pins or sockets therein and is attached to the upper surface 2036*a* of the light board 2036. The connector 2030 of the light board diffuser assembly 2046 is configured to mate with the connector 2032 in the housing 2022 when the light board diffuser assembly 2046 is attached to the housing 2022 as discussed herein.

Figure 1:
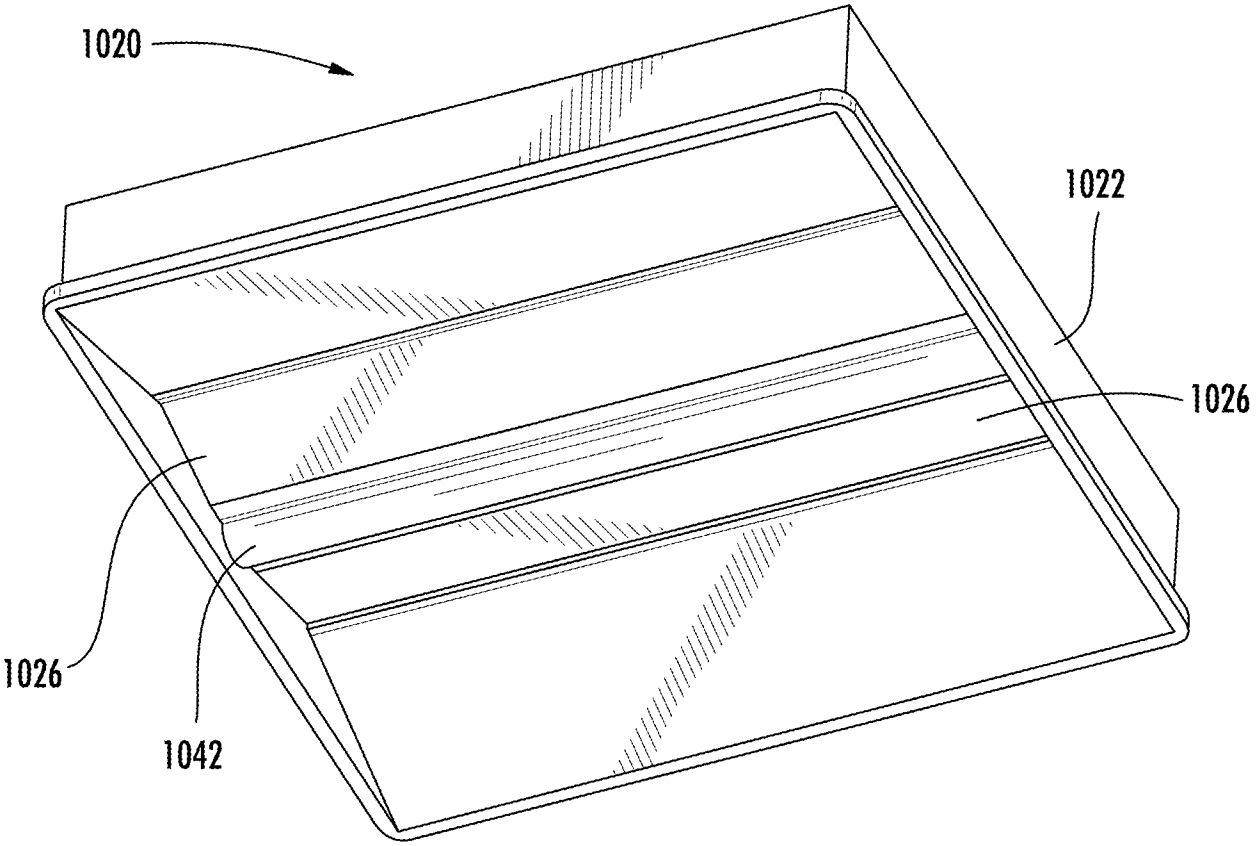
FIG. 1 is a bottom perspective view of a luminaire in accordance with a first embodiment.
Figure 2:
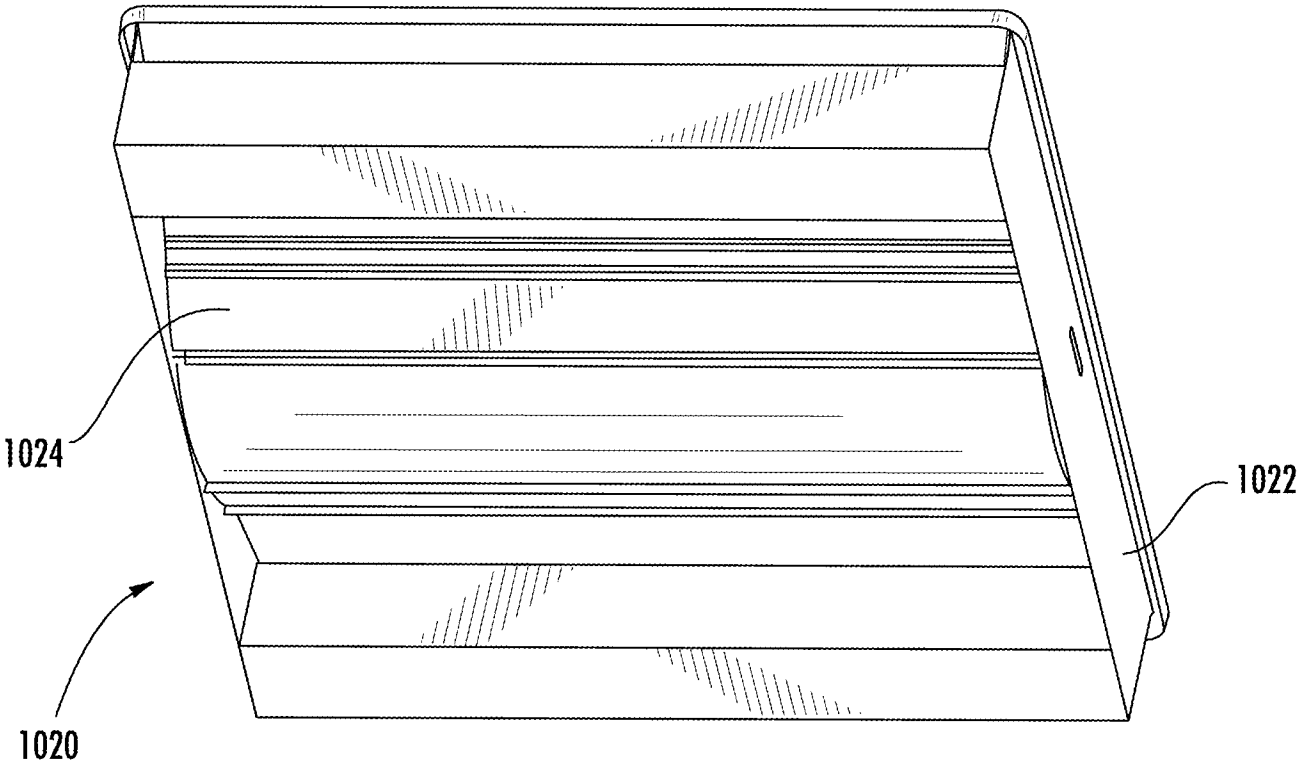
FIG. 2 is a top perspective view of the luminaire of FIG. 1.
Figure 3:
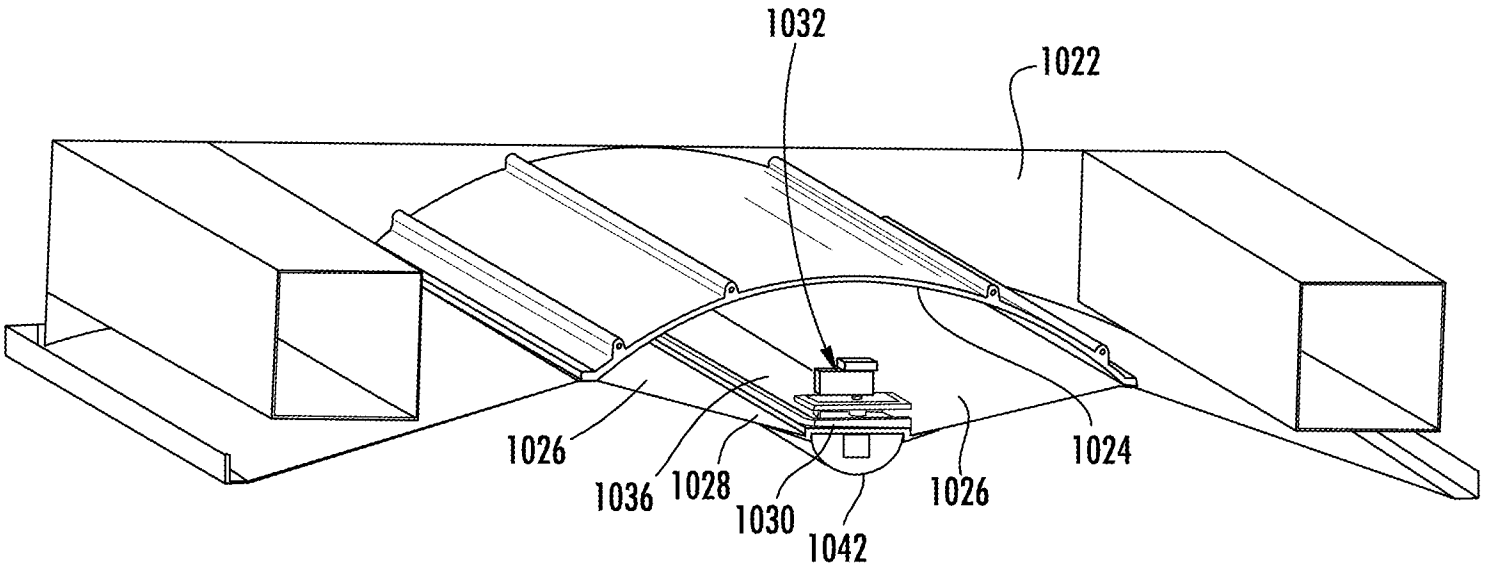
FIG. 3 is a cross-sectional view of the luminaire of FIG. 1.
Figure 4:
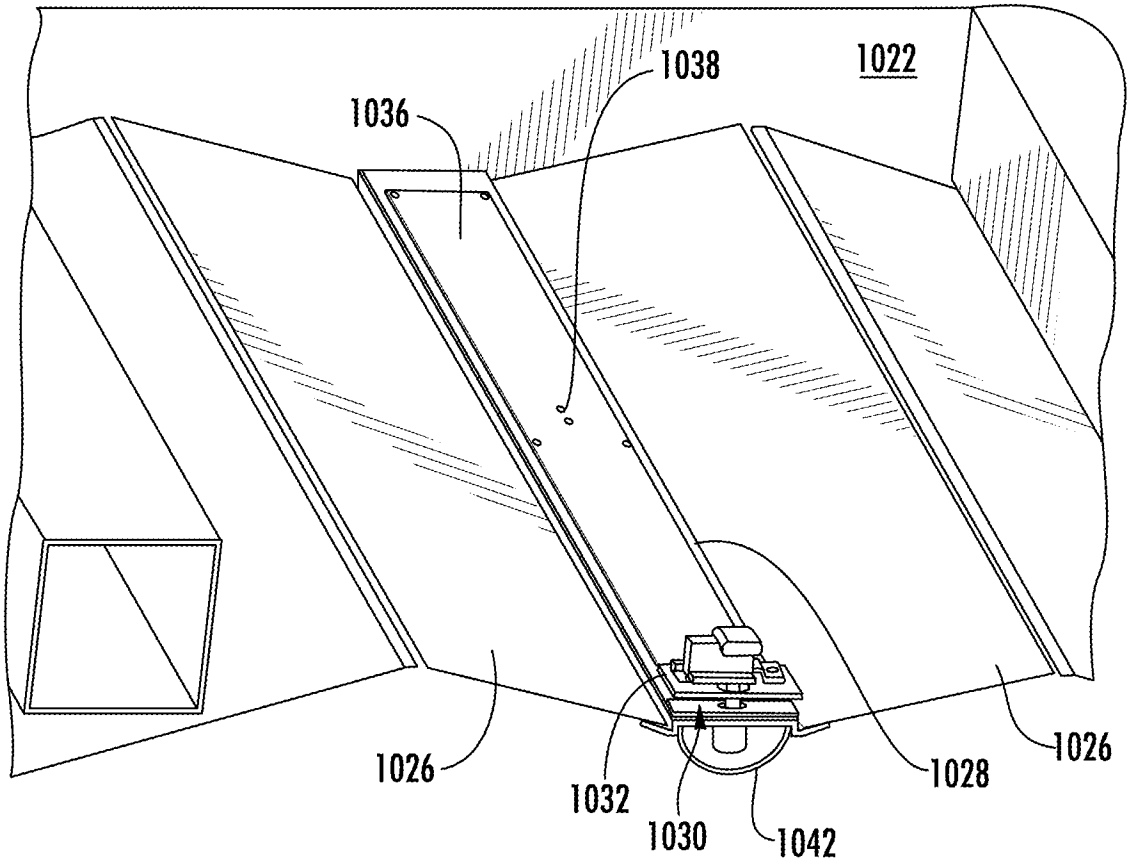
FIG. 4 is a partial cross-sectional view of the luminaire of FIG. 1, with a housing of the luminaire removed, and showing a connector which is mounted on the housing.
Figure 5:
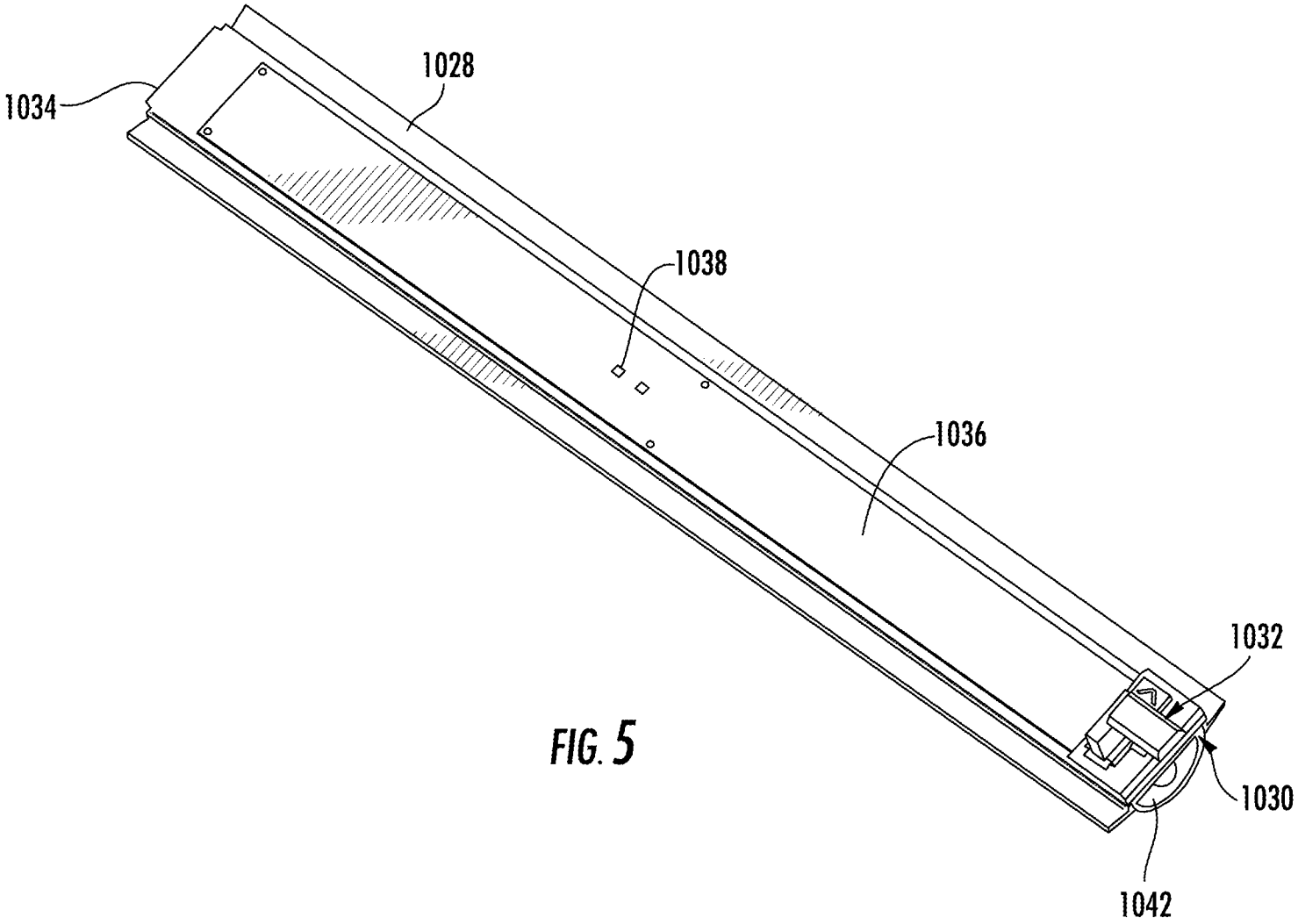
FIG. 5 is a top perspective view of a rail of the luminaire of FIG. 1, and showing the connector which is mounted on the housing.
Figure 6:
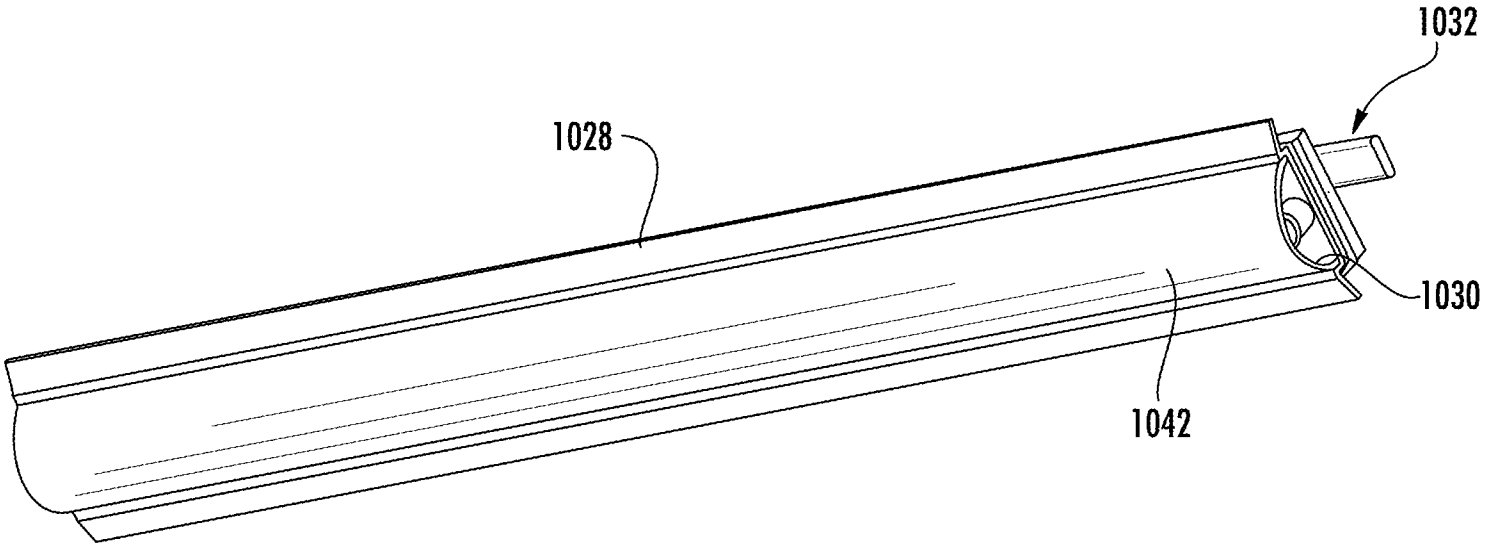
FIG. 6 is a bottom perspective view of the rail of FIG. 5, and showing the connector which is mounted on the housing.
Figure 7:
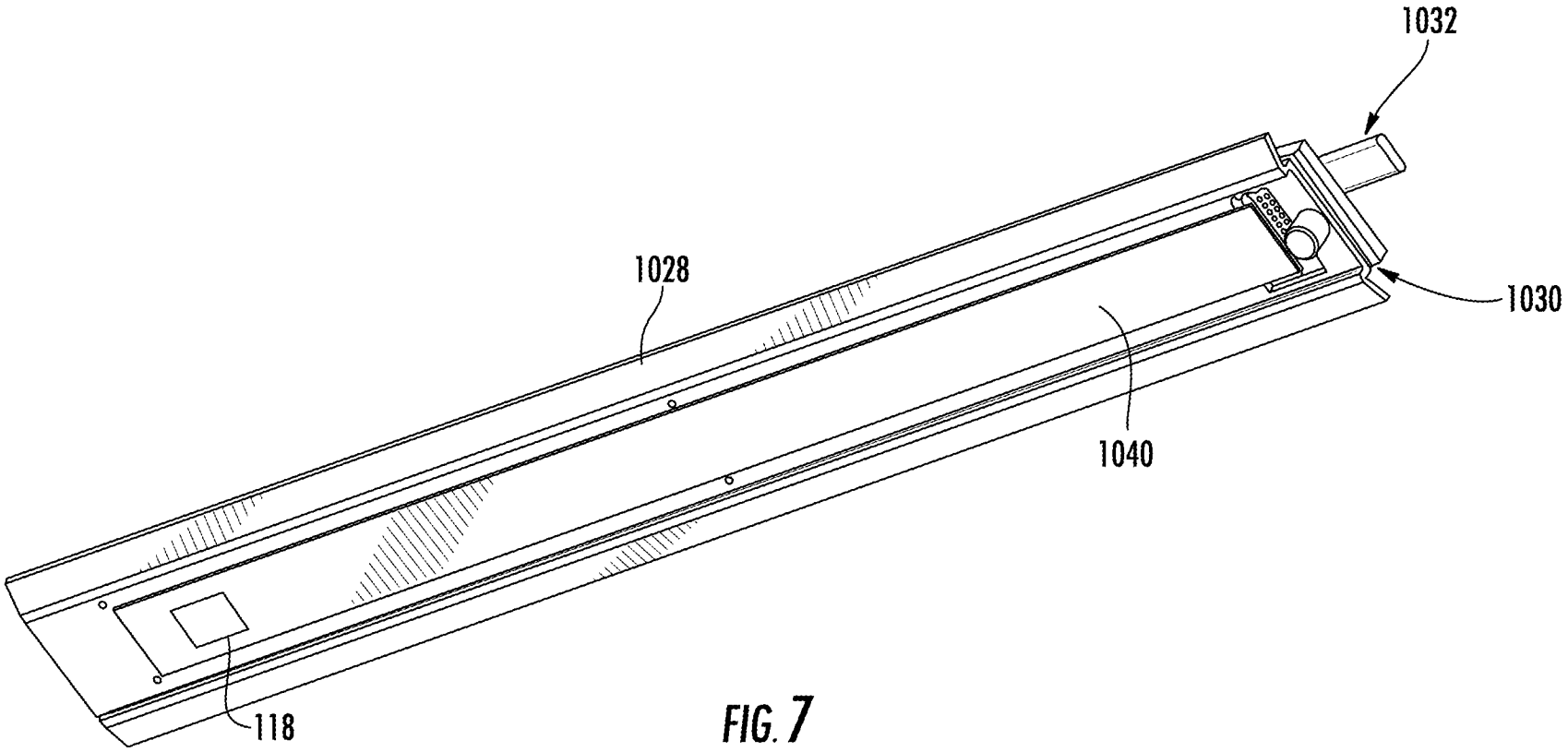
FIG. 7 is a bottom perspective view of the rail of FIG. 5, with a cover removed, and showing the connector which is mounted on the housing.
Figure 8:
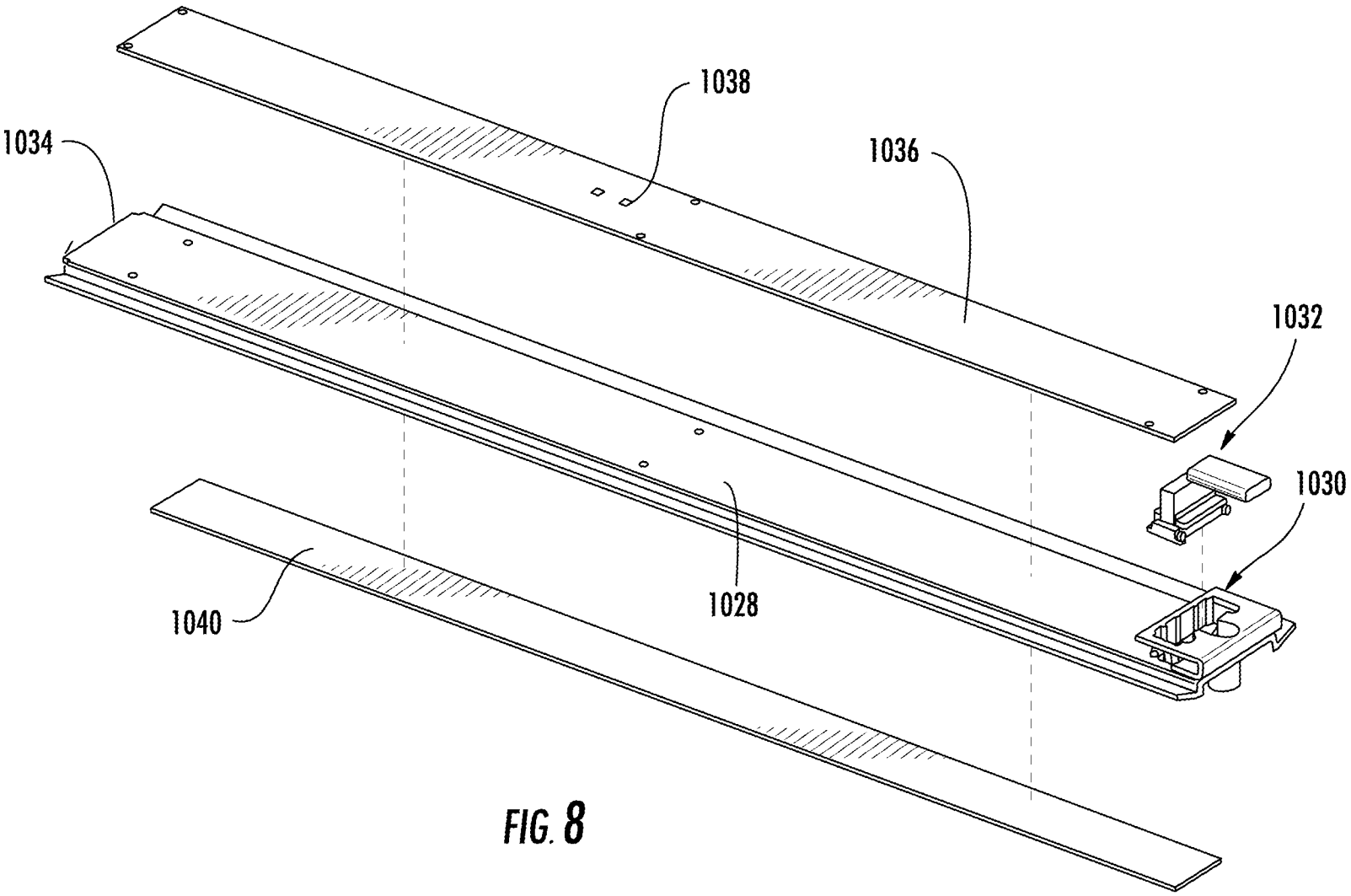
FIG. 8 is an exploded top perspective view of the rail of FIG. 5, with the cover removed, and showing the connector which is mounted on the housing.
Figure 9:
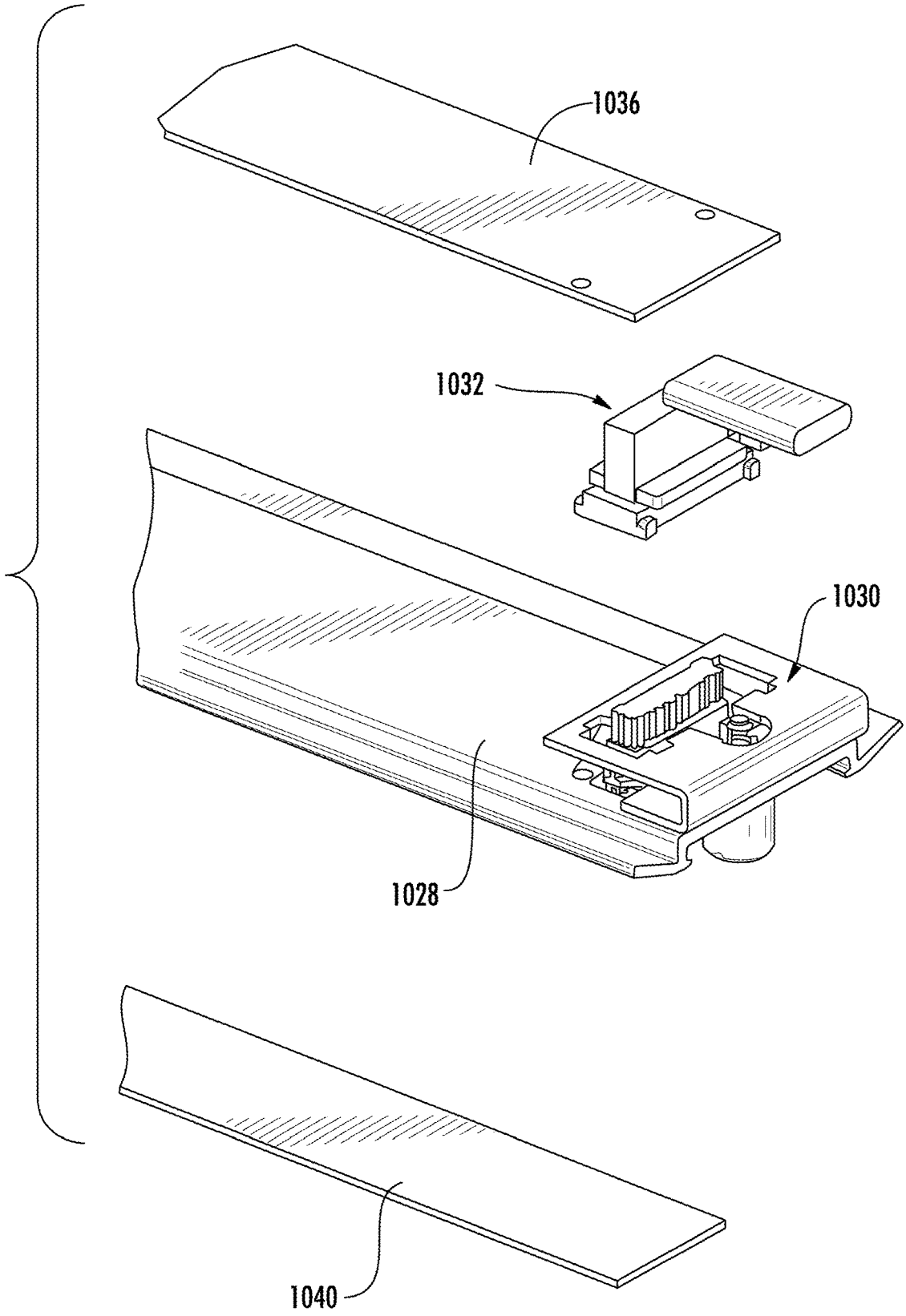
FIG. 9 is a partial exploded top perspective view of the rail of FIG. 5, with the cover removed, and showing the connector which is mounted on the housing.
Figure 10:
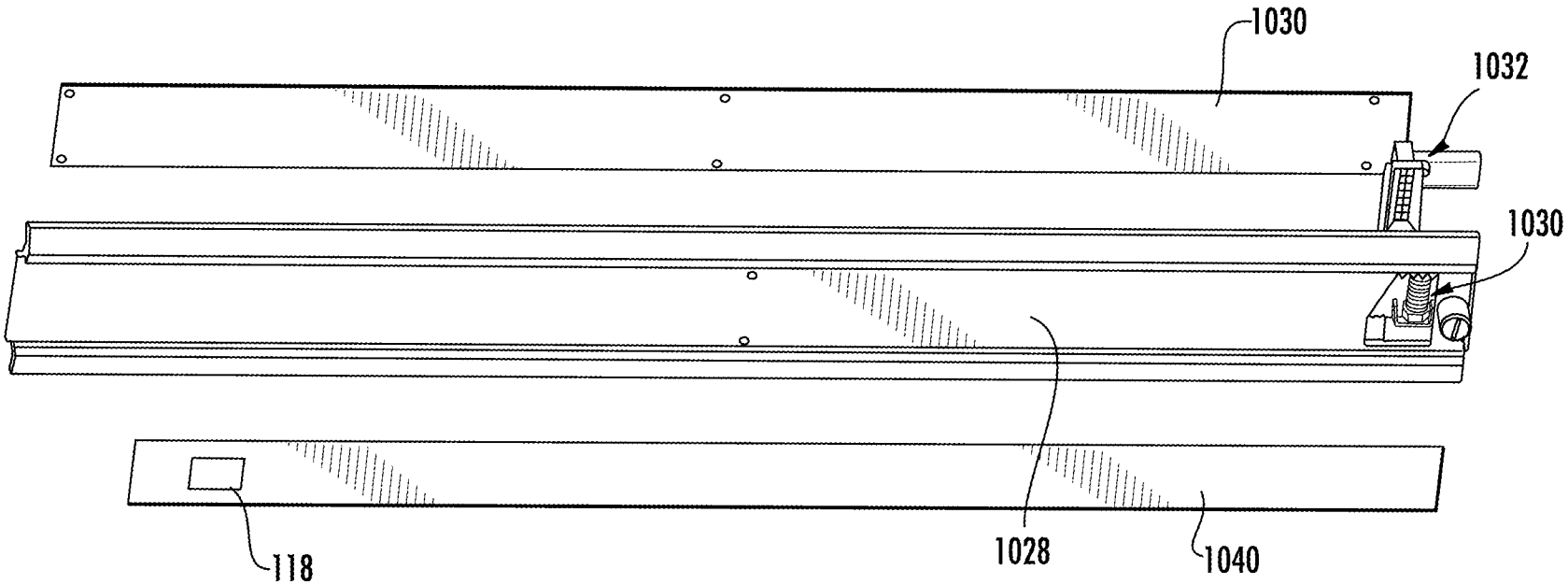
FIG. 10 is an exploded bottom perspective view of the rail of FIG. 5, with the cover removed, and showing the connector which is mounted on the housing.
Figure 11:
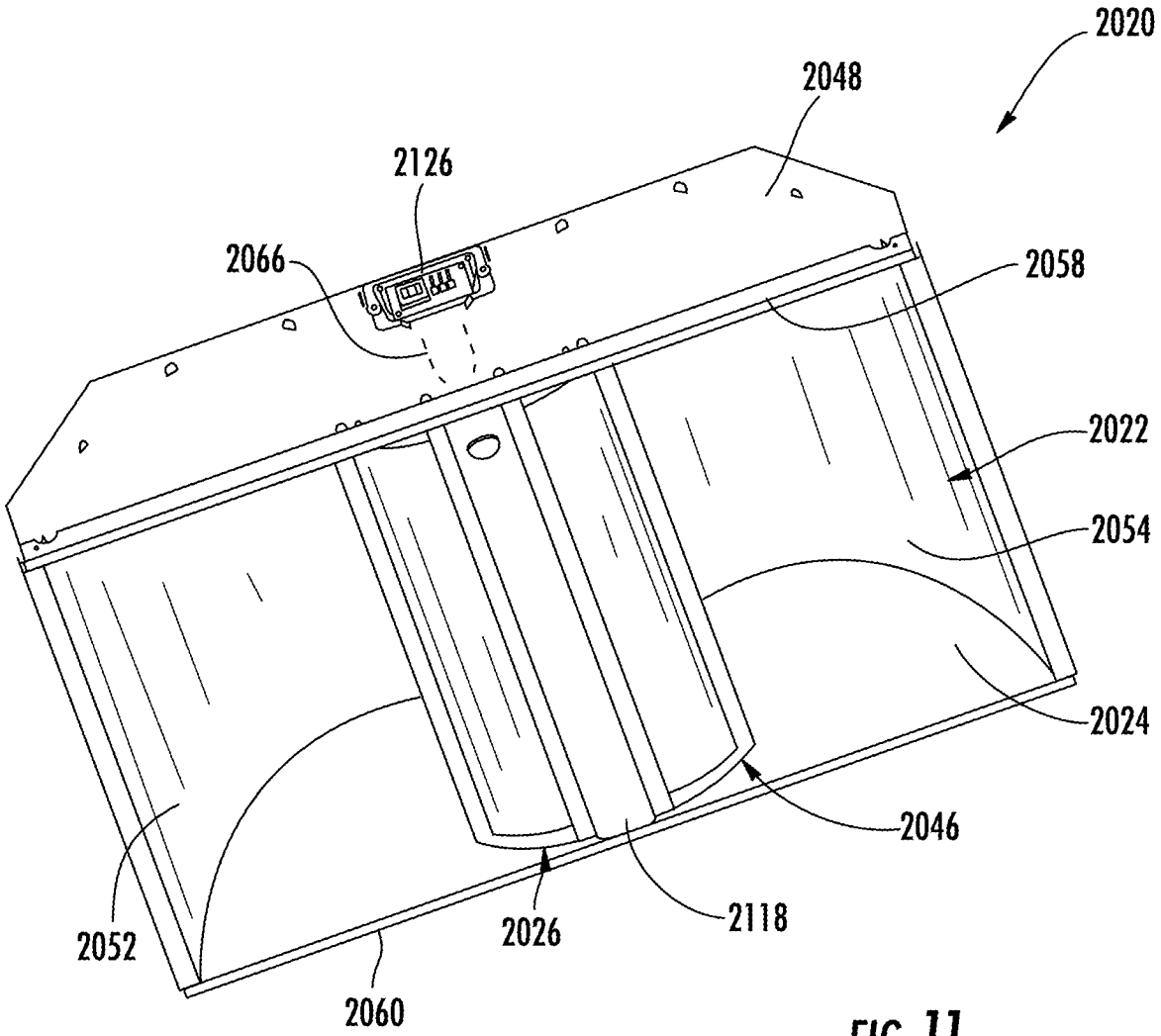
FIG. 11 is a bottom perspective view of a luminaire in accordance with a second embodiment.
Figure 12:
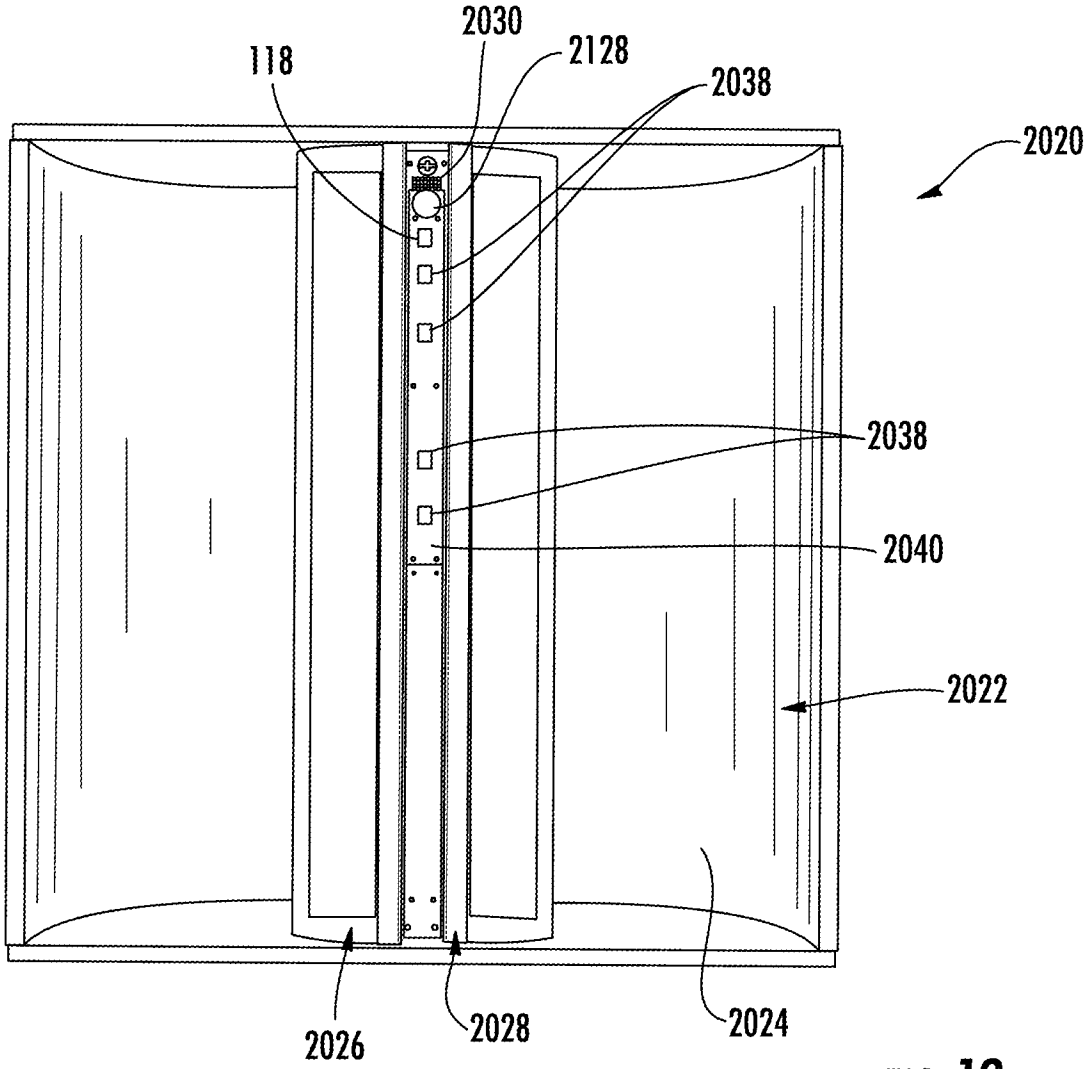
FIG. 12 is a bottom plan view of the luminaire of FIG. 11, without a cover being shown.
Figure 13:
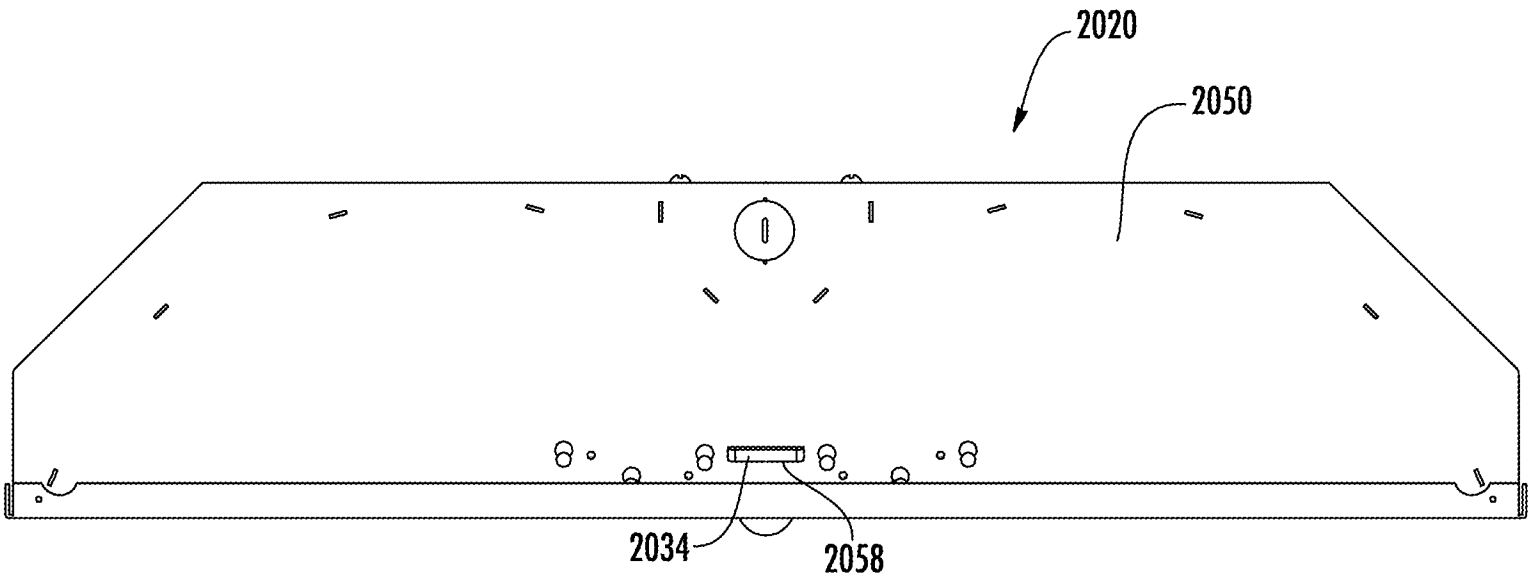
FIG. 13 is an end elevation view of the luminaire of FIG. 11.

As shown in FIGS. 12 and 36, the sensor board 2040 can include various sensors 2128, including, but not limited to, ambient light, temperature, occupancy, motion, noise, air quality and other desired sensors. For example, the sensor board 2040 can include an air quality sensor to provide local air quality feedback to building automation systems, including, but not limited to, heating, ventilation and air conditioning (HVAC) systems. In other examples, the sensors 2128 can be used to provide feedback to the luminaire 2020 so that the luminaire 2020 can provide a more intelligent illumination. For example, motion/occupancy sensors can help ensure the luminaire 2020 is either off or operating at a reduced output when no one is in the near vicinity, ambient light sensor can help ensure that light levels produced by the luminaire 2020 are automatically adjusted based on ambient sunlight from windows and skylights, etc. In addition to providing intelligent illumination, the luminaire 2020 can also provide feedback to individuals within visual or audible range, e.g., to warn the individuals of a potentially dangerous air quality in the area. A pattern of LEDs 2038 can be provided on the sensor board 2040 and a controller 118 can turn on LEDs 2038 to provide the desired visual cues. Some sort of noise generating device (such a speaker or transducer) can also be provided on the sensor board 2040 to provide audible cues. The sensor board 2040 can be electrically coupled to the gateway controller 2045, e.g., via the connector 2030, so as to be powered thereby (see, e.g., FIGS. 34 and 35). The sensor board 2040 is also connected with the light board 2036 to supply power to the light board 2036. The sensor board 2040 can be mounted on the lower surface 2100*b* of the top wall 2100 of the rail 2028, and connected with the light board 2036 through the rail 2028, e.g., via plugs and wiring harness (not shown). The sensor board 2040 can be mounted on the lower surface 2100*b* of the top wall 2100 of the rail 2028. The sensor board 2040 may be mounted on the rail 2028 by an adhesive pad or by fasteners (not shown) or a by combination thereof. In an embodiment, the adhesive pad is a thermal tape to provide for heat transfer from the sensor board 2040 to the rail 2028 which acts as a heat sink.

In some embodiments, the controller 118 may be mounted on, or integrated into, the sensor board 2040. Naturally such a location is not required, and the controller 118 could also be mounted on a separate circuit board supported by the rail 2028. In some embodiments, the controller 118 may be a standalone device and housed separately, and connected with, the luminaire 2020. In an embodiment where the rail 2028 supports the controller 118, the controller 118 can receive various types of input and provide current to the LEDs 2038, per its configuration, based on the input received. As can be appreciated, such a construction allows the connector 2030 to have relatively few inputs (one pair of power inputs and one pair of signal inputs, e.g., voltage, ground, RS+ and RS− for the RS485 protocol—and if desired the signal inputs could be multiplexed onto the power inputs) while providing a variety of control outputs.

As can be appreciated, the connectors 2030, 2032 will typically provide at least two power terminals. The power can be provided from an Ethernet cable providing power over Ethernet (PoE) or other desirable input. An advantage of using a PoE source is that the power source is low voltage, which simplifies the design of the luminaire 2020 (and luminaire 1020) and also makes it simple to provide power without a need for installing high voltage conduit (e.g., one simply runs a network cable to the location and power and data is provided).

If PoE is used to power the luminaire 2020 (or luminaire 1020) then an RJ45 port 2126 (or other suitable port) can be provided in the luminaire 2020 (luminaire 1020), e.g., directly and/or via gateway controller 2045 housed in junction box 2044. The gateway controller 2045 receive power and control signals from the Ethernet via RJ45 port 2126, and outputs power and control signals to the luminaire 2020 (luminaire 1020). In some embodiments, the gateway controller 2045 connects with the sensor board 2040 (sensor board 1040), e.g., for sending signals to the controller 118. To make the power and data connections, connector 2032 (connector 1032) of the junction box 2044 communicatively connects with connector 1030, 2030 of the light board diffuser assembly 2046 (rail 1028/light board 1036/sensor board 1040), e.g., to send power and data signals to the light board diffuser assembly 2046 (rail 1028/light board 1036/sensor board 1040), and receive data signals from the light board diffuser assembly 2046 (rail 1028/light board 1036/sensor board 1040). The connectors 2032 (connector 1032) and 2030 (connector 1030) allow the light board diffuser assembly 2046 (rail 1028/light board 1036/sensor board 1040) to be removably disconnected/connected from/to the gateway controller 2045 and the rest of the luminaire 2020 (luminaire 1020).

In some embodiments, the gateway controller 2045 can convert the received Ethernet or other higher-level protocol to a lower-level, e.g., a building management based protocol. For example, the gateway controller 2045 can convert PoE, UPoE, etc. to RS232, RS485, CAN, BACnet, digital addressable lighting interface (DALI), TRANSCEND by MOLEX, etc., and vice versa. With regard to connectors 2032 (connector 1032) and 2030 (connector 1030), it should be noted that the gateway controller 2045 can make wired and/or wireless connections with the luminaire 2020 (luminaire 1020), e.g., via a hard-wired harness and/or wirelessly via Bluetooth low energy (BTLE), ZigBee, EnOcean, IEEE 802.11 (WiFi), etc.

Figure 35:
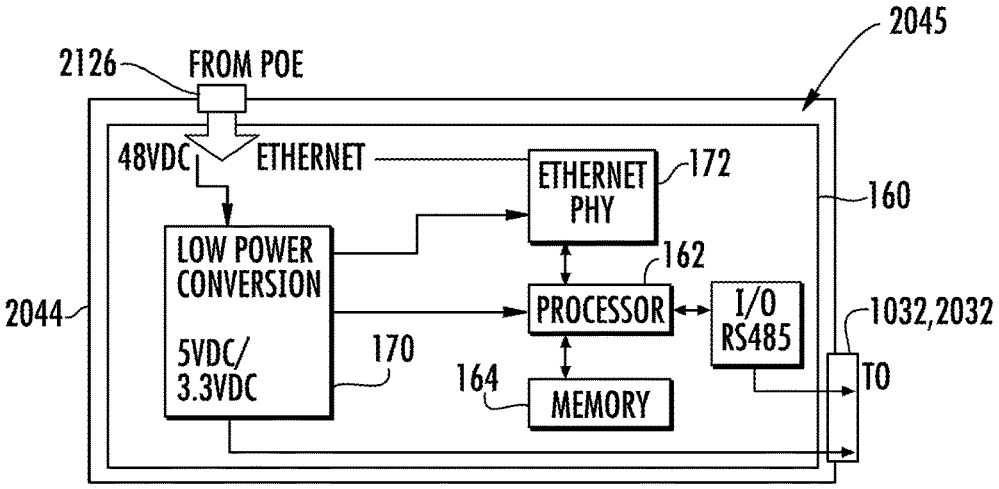
FIG. 35 is an example circuit board for a gateway controller.

The gateway controller 2045 can be implemented on a circuit board 160 (FIG. 35). The circuit board 160 can include one or more processors 162 and one or more memory devices 164, which in some embodiments can be implemented together as a microprocessor with memory. The memory devices 164 can include one or more of a program memory, a cache, random access memory (RAM), a read only memory (ROM), a flash memory, a hard drive, etc., and/or other types of memory. In some embodiments, the memory 164 can store instructions (e.g., compiled executable program instructions, un-compiled program code, some combination thereof, or the like), which when performed (e.g., executed, translated, interpreted, and/or the like) by the processor 162, causes the processor 162 to perform the conversions, translations, logic and any other processes described herein.

Additionally, or alternatively, the gateway controller 2045 can include a power converter 170 to convert 48 VDC, or other voltage, received via the Ethernet, to 5 VDC and 3.3 VDC, or other voltages used by the gateway controller 2045, the sensor board 2040 (sensor board 1040), the LEDs 2038 (LEDs 1038) and/or other components of the luminaire 2020 (luminaire 1020). Ethernet physical layer 172 connects the Ethernet based signals with the processor 162, and Rs485, or other, input/output (I/O) 174 connects the processor 162 with the luminaire 2020 (luminaire 1020). The gateway controller 2045 sends power and/or data signals to the luminaire 2020 (luminaire 1020) via connectors 2032 (2032) and 2030 (connector 1030). The gateway controller 2045 can also receive signals from the luminaire 2020 (luminaire 1020), e.g., from the sensors 2128 and 2129, located on the sensor board 2040 (sensor board 1040) and light board 2036 (light board 1036) of the luminaire 2020 (luminaire 1020) respectively. In some embodiments, the gateway controller 2045 can process the sensor signals 2128 and/or 2129 for direct control the luminaire 2020 (luminaire 1020) based on data received from the sensor signals. In some embodiments, the gateway controller 2045 can send the sensor signals 2128 and/or 2129 to a server connected with the gateway controller 2045 via Ethernet for processing and sending new control signals to the luminaire 2020 (luminaire 1020). In some embodiments, the control signals are processed by controller 118 located on sensor board 2040 (sensor board 1040) for controlling the LEDs 2038 (LEDs 1038) based on the control signals. In some embodiments, the controller 118 directly processes the sensor signals for controlling the LEDs 2038.

The sensor board 2040 (sensor board 1040) can include power converter 178 for converting 5 VDC, or other voltage, received from the gateway controller 2045, to 3.3 VDC, or other voltages used by the controller 118. The sensor board 2040 (sensor board 1040) can also include an RS485, or other, I/O 176 to communicatively connect the controller 118 with the gateway controller 2045 to receive power and data signals from the gateway controller 2045, and send sensor signals, e.g., from sensors 2128, and any other information to the gateway controller 2045. The controller 118 can include a I^2C sensor bus for communicating with the sensors 2128. In some embodiments, the controller 110 can also process the sensor signals 2128 and/or 2129 for direct control the LEDs 2038 (LEDs 1038) on light board 2036 (light board 1036) based on data from the sensor signals. In some embodiments, the controller 118 can be implemented as a microprocessor with memory. The memory can include one or more of a program memory, a cache, random access memory (RAM), a read only memory (ROM), a flash memory, a hard drive, etc., and/or other types of memory. The memory can store instructions (e.g., compiled executable program instructions, un-compiled program code, some combination thereof, or the like)), which when performed (e.g., executed, translated, interpreted, and/or the like) by the controller 118, causes the controller 118 to perform the conversions, translations, logic and any other processes described herein.

The light board 2036 (light board 1036) can also include sensors and sensor supporting circuitry 2129, e.g., color sensor and/or I^2C sensor bus. The light board 2036 (light board 1036), or in some embodiments the sensor board 2040 (sensor board 1040), can include power converter 180, e.g., a buck converter, for providing a determined constant current to control an illumination of LEDs 2038 (LEDs 1038), e.g., based on control signals from controller 118. The controller 118 sends the control signals and a pulse width modulation (PWM) signal to the power converter 180 for controlling the on, off, colors, illumination levels, etc. of the LEDs 2038 (LEDs 1038). The power converter 180 can also receive and modulate 48 VDC received from the sensor board 2040 (sensor board 1040) for powering the LEDs 2038 (LEDs 1038).

The sensor board 2040 (sensor board 1040) and/or the light board 2036 (light board 1036) can also include red, green, blue, white (RGBW) LEDs. The controller 118 can activate the RGBW LEDs to use the luminaire 2020 (luminaire 2010) as indicators of pathways, diagnostics, general information and/or in emergency situations. The RGBW LEDs may be part of LEDs 2038 (LEDs 1038), or separate LEDs. In some embodiments, the controller 118 can strobe the RGBW LEDs in a direction of egress. In some embodiments, the controller 118 lights the luminaire red to indicator a fire or blue to indicate police. In some embodiment, the activated LED(s) indicates that the controller 118 detected a potentially dangerous chemical or gas in the area (e.g., via a connected air quality sensor), that the controller detected the presence of an earthquake (e.g., via a connected accelerometer), that there is a terror alert for the area, etc. In some embodiments, the activated LED(s) can indicate a status of a power and/or network data connections to the luminaire 2020 (luminaires 2010). In some embodiments, the activated LED(s) can indicate a room's occupancy state, etc. Other examples are possible.

In some embodiments, the circuit board 160, sensor board 2040 (sensor board 1040) and/or light board 2036 (light board 1036) are sized and shaped to fit the rail 2028 (rail 1028) and/or luminaire 2020 (luminaire 1020), e.g., via a round shape, an oval shape, a rectangular shape, a square shape, a triangular shape, an irregular shape, etc. The circuit board 160, sensor board 2040 (sensor board 1040) and/or light board 2036 (light board 1036) may include one or more physical boards connected with each other and in some embodiments stacked relative to each other. It will be appreciated that where circuit board 160, sensor board 2040 (sensor board 1040) and/or light board 2036 (light board 1036) are described, it is described by way of non-limiting examples, such that alternative assemblies on which circuitry and/or other electronic components may be embodied may be substituted for circuit board 160, sensor board 2040 (sensor board 1040) and/or light board 2036 (light board 1036) within the scope of the disclosure, including, but not limited to, printed circuit board assemblies, circuit boards having point to point construction, application-specific integrated circuit (ASIC), field programmable gate array (FPGA), etc.

Figure 25:
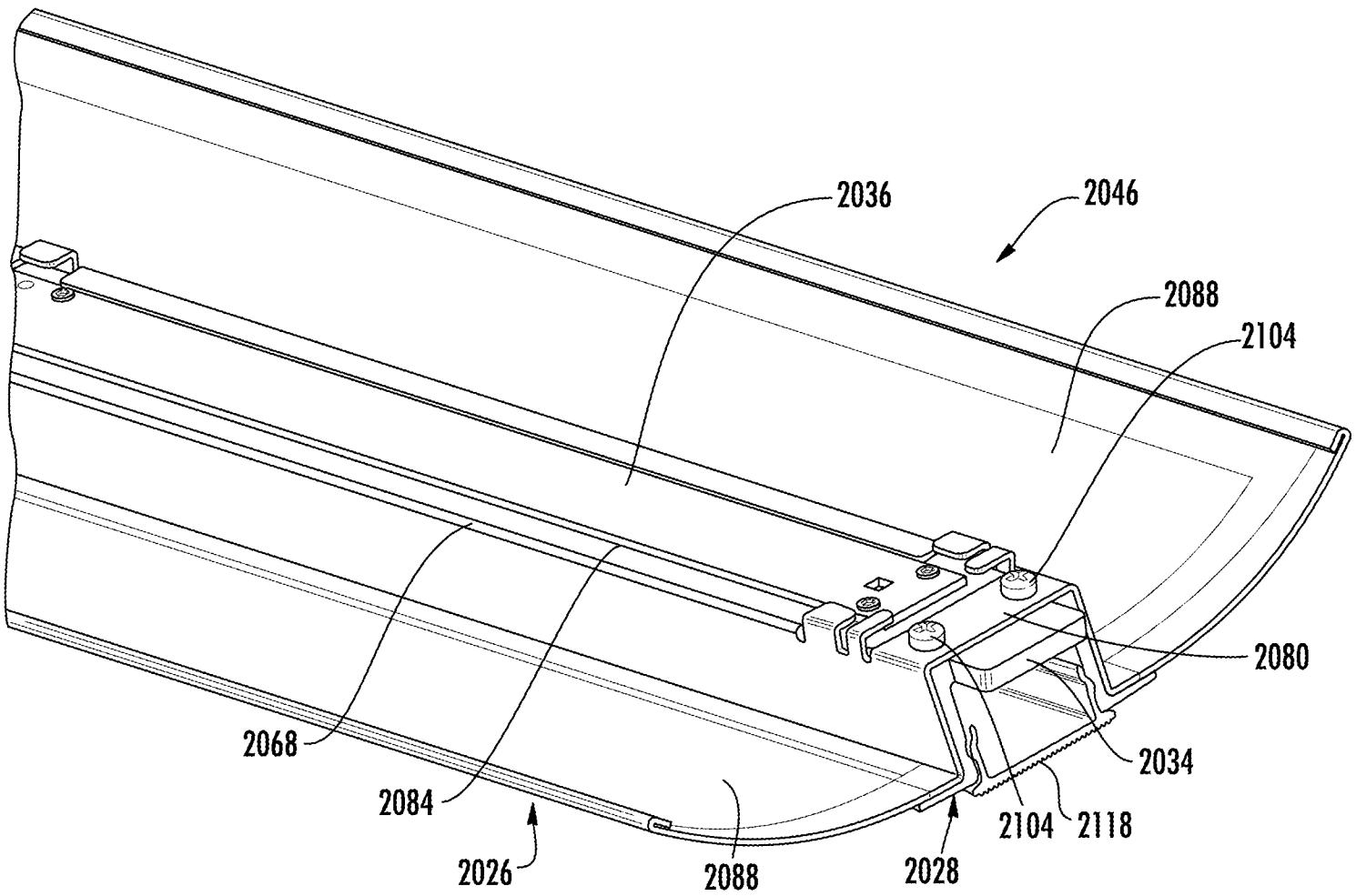
FIGS. 25 and 26 are partial top perspective views of the light board diffuser assembly of FIG. 17.
Figure 26:
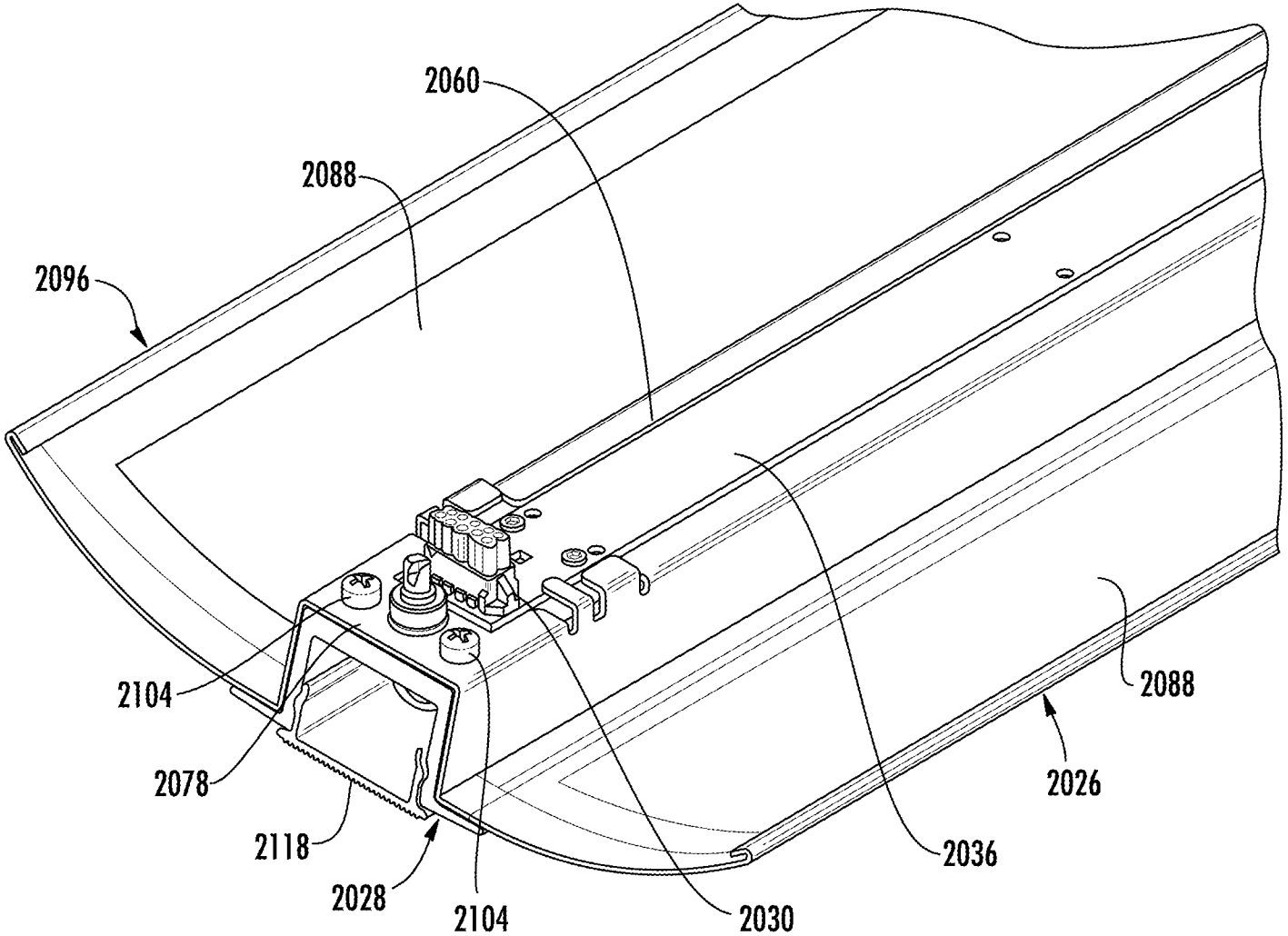
Figure 27:
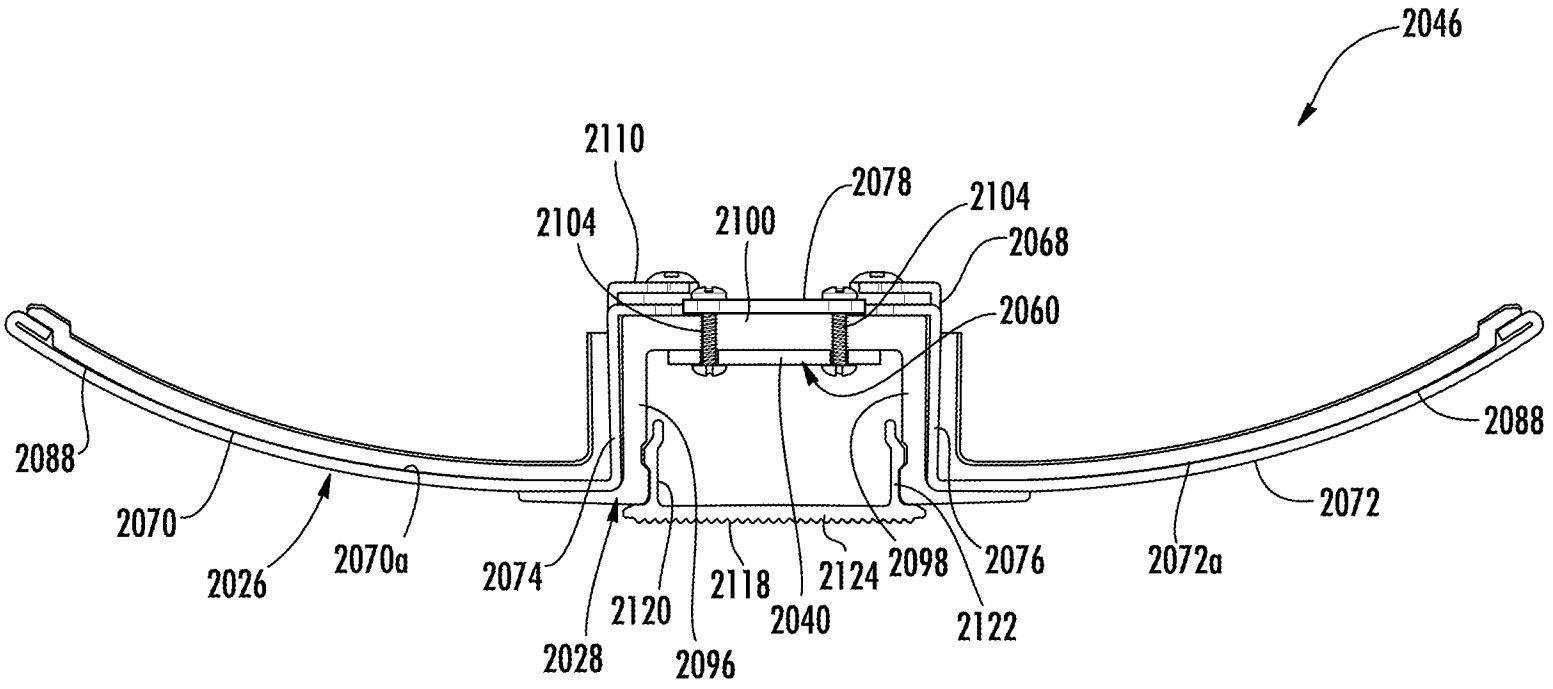
FIG. 27 is a cross-sectional view of the light board diffuser assembly of FIG. 17.

As shown in FIG. 25-28, the rail 2028 seats within the cavity 2082 of the diffuser 2026 such that the top wall 2100 of the rail 2028 engages the lower surfaces of the top wall sections 2078, 2080, the tab 2034 extends outwardly from the top wall section 2080, the upright walls 2096, 2098 engage the upright walls 2074, 2076, and the side sections 2092, 2094 engage the side sections 2070, 2072. The rail 2028 is releasably attached to the diffuser 2026 by the attachments 2104 (or the diffuser 2026 is releasably attached to the rail 2028 by the attachments 2104). In an embodiment, the attachments 2104 are fasteners which extend through the top wall sections 2078, 2080 of the diffuser 2026 and through the top wall 2100 of the central section 2090 of the rail 2028 as shown in FIGS. 25 and 26. Other attachments for releasably attaching the rail 2028 to the diffuser 2026, such as clips are within the scope of the disclosure. The light board 2036 is exposed through the aperture 2084 such that light from the LEDs 2038 shines upwardly.

The light board diffuser assembly 2046 is attached to the housing 2022 with one hand of a user by inserting the tab 2034 into the slot 2058 in the end cap 2050 and then pivoting the light board diffuser assembly 2046 upwardly around the tab 2034 until the connector 2030 on the light board diffuser assembly 2046 engages with the connector 2032 in the housing 2022. This aligns the rail 2028, the light board 2036 and the diffuser 2026 with the reflector 2024. The light generated by the LEDs 2038 on the light board 2036 is reflected by the reflector 2024 such that the light is reflected downwardly from the luminaire 2020.

Figure 29:
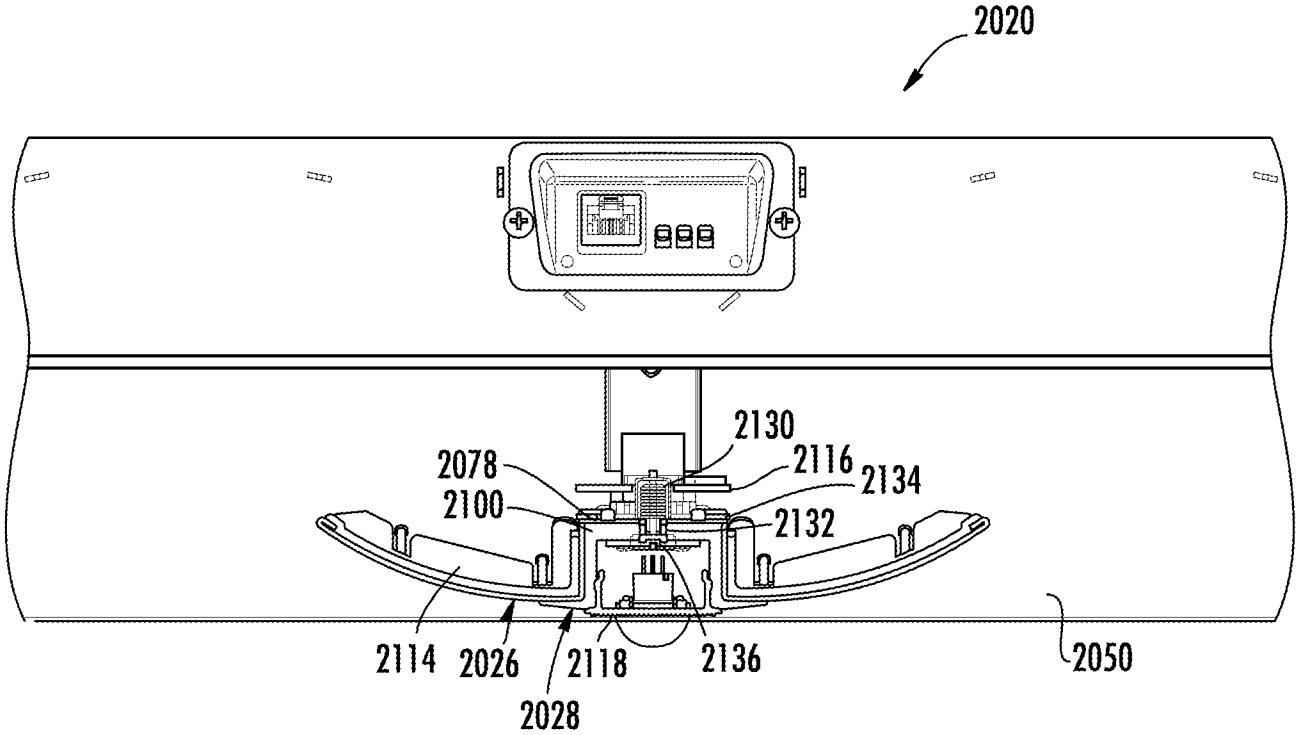
FIG. 29 is a partial cross-sectional view of the luminaire of FIG. 17.
Figure 32A:
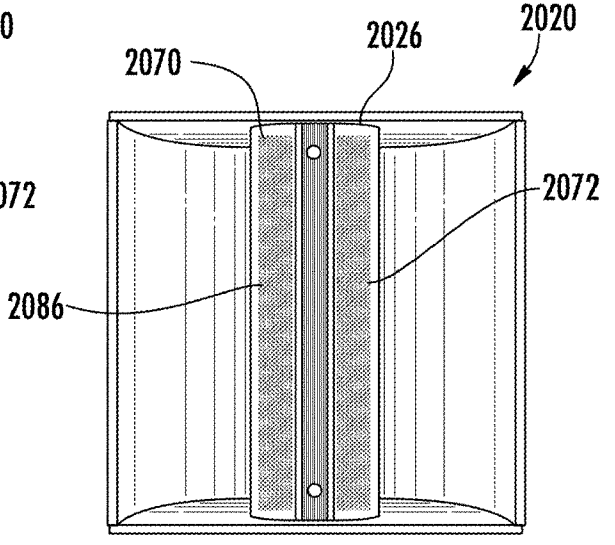
FIGS. 30A, 31A, 32A, 33A and 34A are bottom plan views of alternate embodiments of the diffuser for the light board diffuser assembly.
Figure 32B:
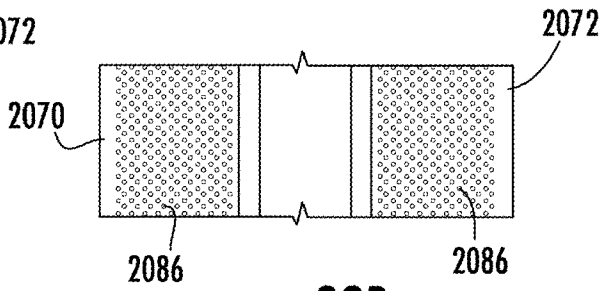
FIGS. 30B, 31B, 32B, 33B and 34B are partial enlarged bottom views of the alternate embodiments shown in FIGS. 30A, 31A, 32A, 33A and 34A, respectively.
Figure 31A:
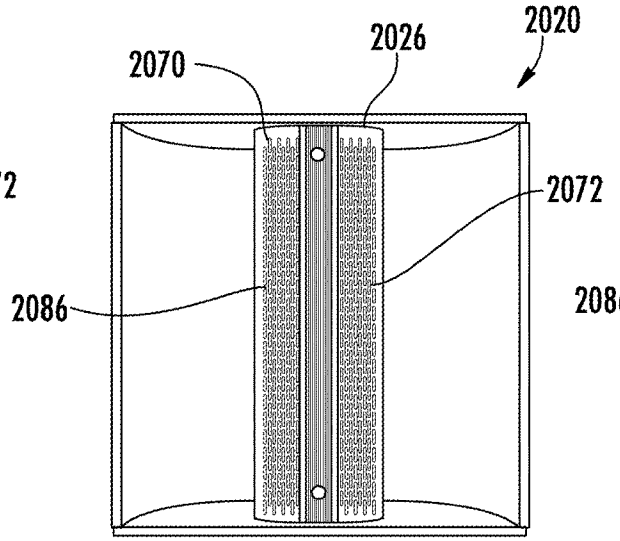
Figure 31B:
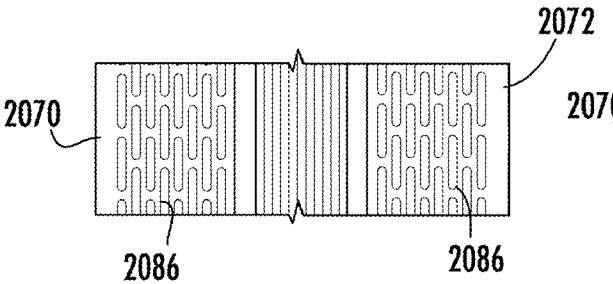
Figure 30A:
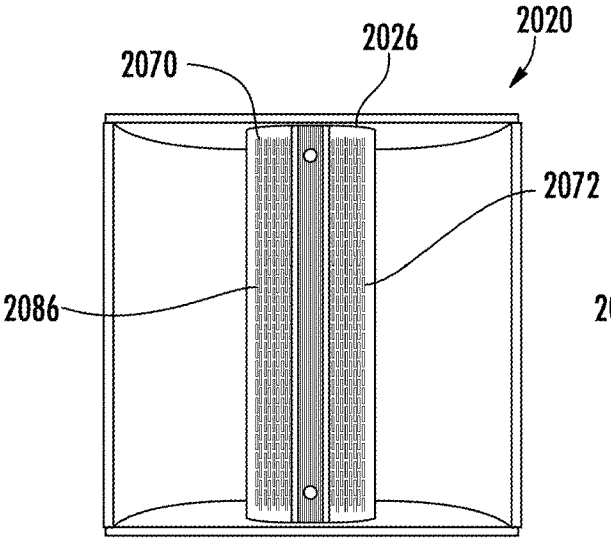
Figure 30B:
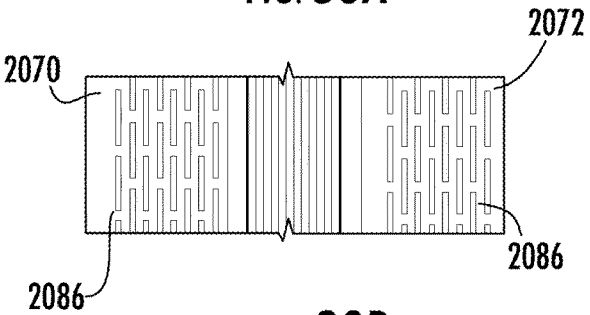
Figure 34A:
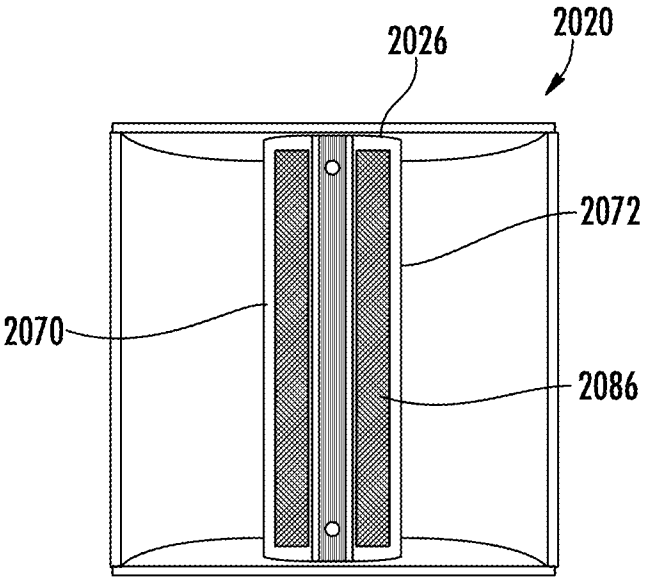
Figure 34B:
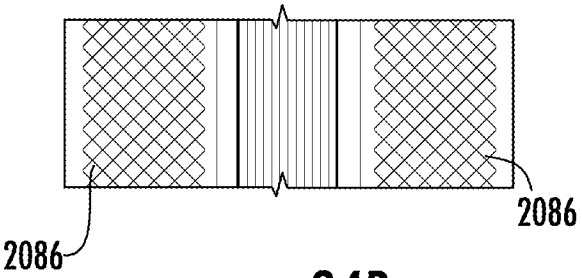
Figure 33A:
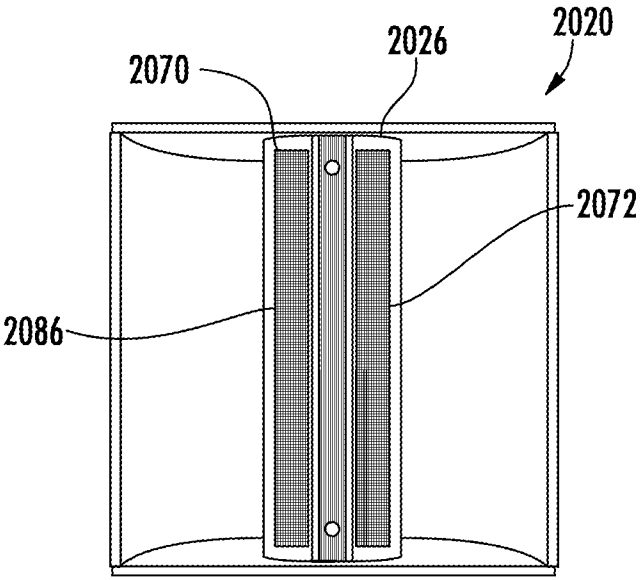
Figure 33B:
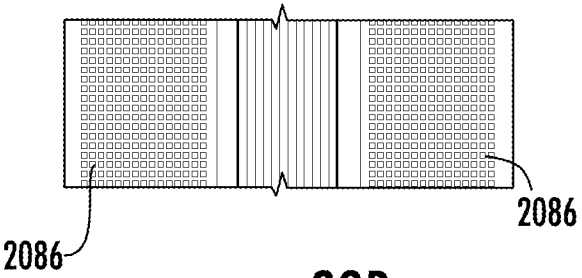

In an embodiment, the bracket 2116 of the housing 2022 has a male threaded mount 2130 provided thereon, which has a threaded opening. Aligned apertures 2132, 2134, see FIGS. 14 and 29, are provided through the top wall 2100 of the rail 2028 and through the top wall section 2078 of the diffuser 2026. When the light board diffuser assembly 2046 is inserted into the housing 2022 as described herein, a fastener 2136, such as a screw, is seated through the apertures 2132, 2134 and threadedly engages with the mount 2130. In an embodiment, this causes the connectors 2030, 2032 to fully engage when the fastener 2136 fully seats within the mount 2130. Such a mount 2130 and fastener 2136 may also be used with the luminaire 1020.

In an embodiment, the housing 2022 further includes frame parts 2114 which are attached to each end cap 2048, 2050 (only shown on end cap 2050 in FIG. 14) to fill any space between the ends of the light board diffuser assembly 2046 and the end caps 2048, 2050, thereby blocking light emitted by the light board 2036 through any such space. In an embodiment, the frame parts 2114 mirror the shapes of the side sections 2070, 2072 of the diffuser 2026. In an embodiment, the frame parts 2114 seat above the side sections 2070, 2072 of the diffuser 2026. In an embodiment, the frame parts 2114 are integrally formed with the respective end cap 2048, 2050

The light board diffuser assembly 2046 can be detached from the housing 2022 with one hand of a user. If the mount 2130 and fastener 2136 are provided/engaged, the fastener 2136 is first unscrewed from the mount 2130. Thereafter, the light board diffuser assembly 2046 is pulled downwardly to disengage the connector 2030 on the light board diffuser assembly 2046 from the connector 2032 in the housing 2022. During this detachment, the light board diffuser assembly 2046 pivots downwardly around the tab 2034 which is still engaged within the slot 2058 in the end cap 2050. Once the connector 2030 on the light board diffuser assembly 2046 is disengaged from the connector 2032 in the housing 2022, the light board diffuser assembly 2046 is pulled such that the tab 2034 disengages from the slot 2058 in the end cap 2050 to remove the light board diffuser assembly 2046 from the housing 2022.

Once the light board diffuser assembly 2046 is removed from the housing 2022, the diffuser 2026 can be easily detached from the subassembly 2060, e.g. the rail 2028, the connector 2030, the light board 2036 and the sensor board 2040, of the light board diffuser assembly 2046. This is easily accomplished by removing the attachments 2104 which couple the diffuser 2026 and the subassembly 2060 together. The subassembly 2060 forms the most expensive component of the luminaire 2020. The subassembly 2060 can be used with diffusers 2026 having differing patterns of perforations 2086 so that the user can customize the look of the luminaire 2020 depending upon the user's needs or likes. This can be performed in the field. FIGS. 30A-34B show example patterns of perforations 2086 that may be used. The same subassembly 2060 can be used which saves costs. In addition, if an issue arises with the function of the subassembly 2060, the subassembly 2060 can be hot-swapped in the field with a new subassembly 2060 by removing the light board diffuser assembly 2046 from the housing 2022, and then removing the subassembly 2060 from the diffuser 2026. The fixed light board diffuser assembly 2046 is then easily reattached in the field by the user. The user does not need to remove the housing 2022 from the ceiling, which can be time consuming and expensive. Yet as another alternative, the entire light board diffuser assembly 2046 can be replaced with a new light board diffuser assembly and attached to the housing 2022.

Figure 17:
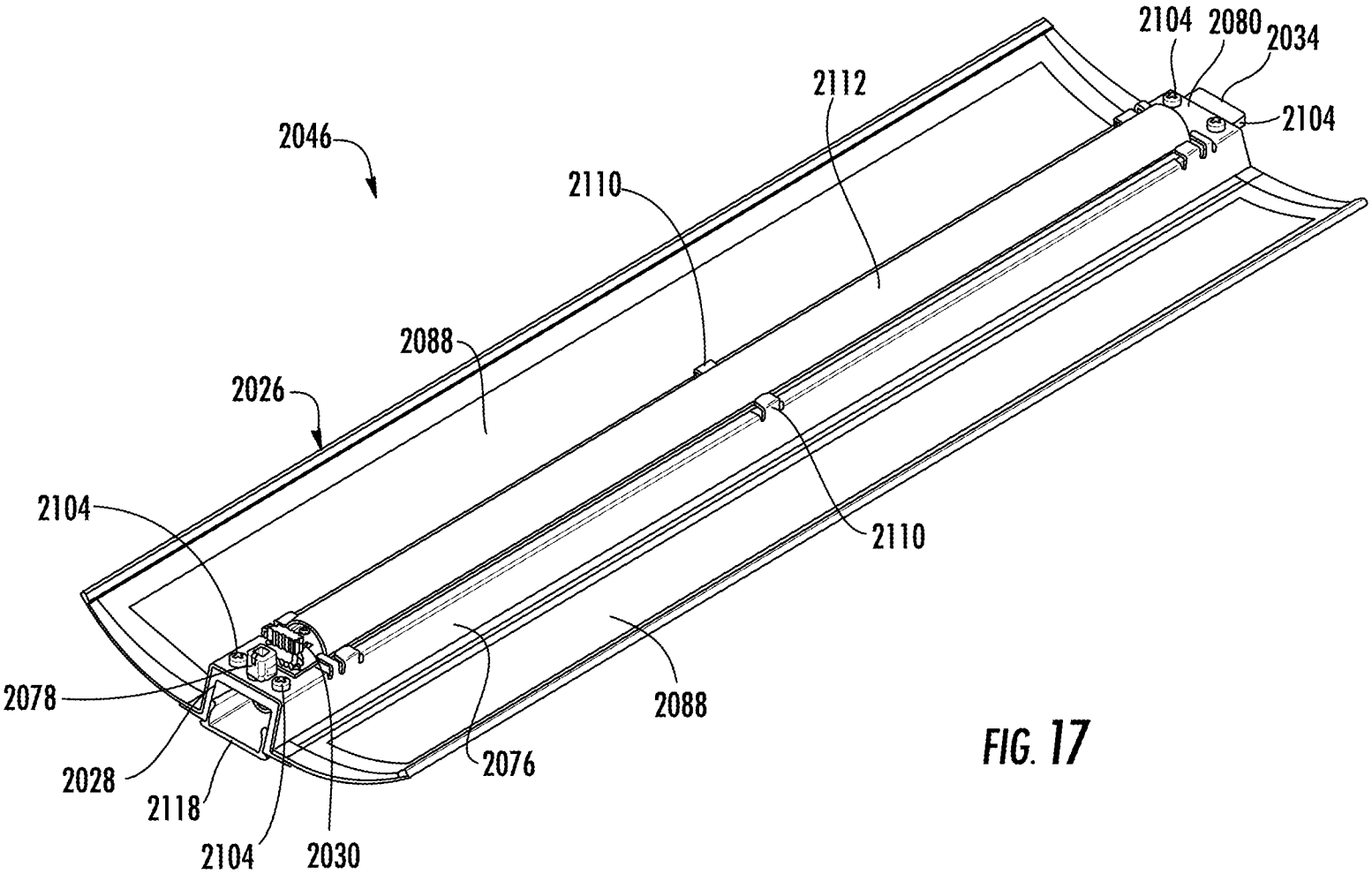
FIG. 17 is a top perspective view of a light board diffuser assembly of the luminaire of FIG. 11.
Figure 18:
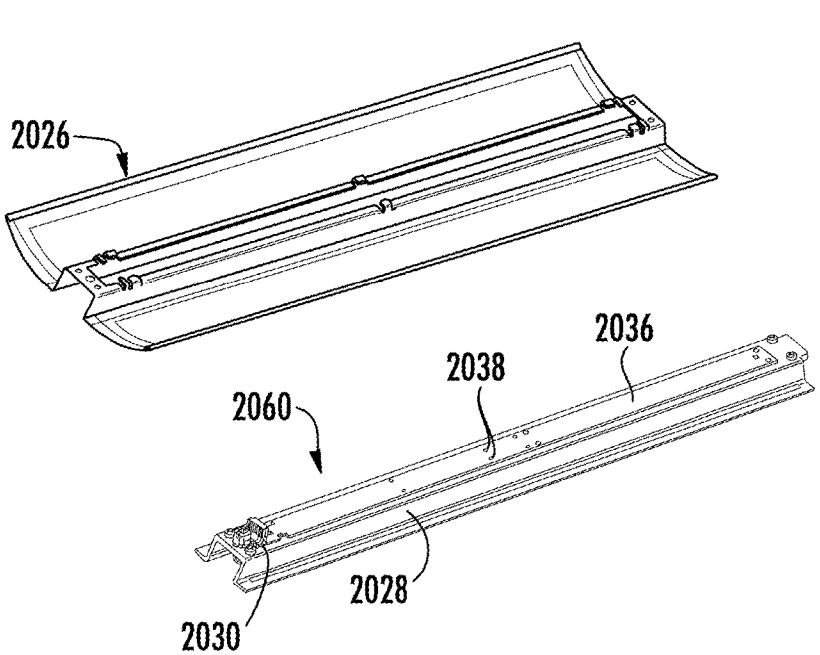
FIG. 18 a partial exploded perspective view of the light board diffuser assembly of FIG. 17.

In an embodiment, a plurality of fingers 2110, see FIG. 17, which may be L-shaped or generally L-shaped, extend from the upper ends of the upright walls 2074, 2076 of the diffuser 2026 and overlap the aperture 2084 of the diffuser 2026. In an embodiment, a clear dust cover 2112 is attached to the diffuser 2026 by the fingers 2110 and covers the light board 2036, while allowing the light emitted by the LEDs 2038 to shine therethrough and be reflected downwardly by the reflector 2024. The dust cover 2112 assists in a user cleaning the luminaire 2020 because the user can easily move a cloth over the dust cover 2112. The dust cover 2112 may be omitted.

Figure 28:
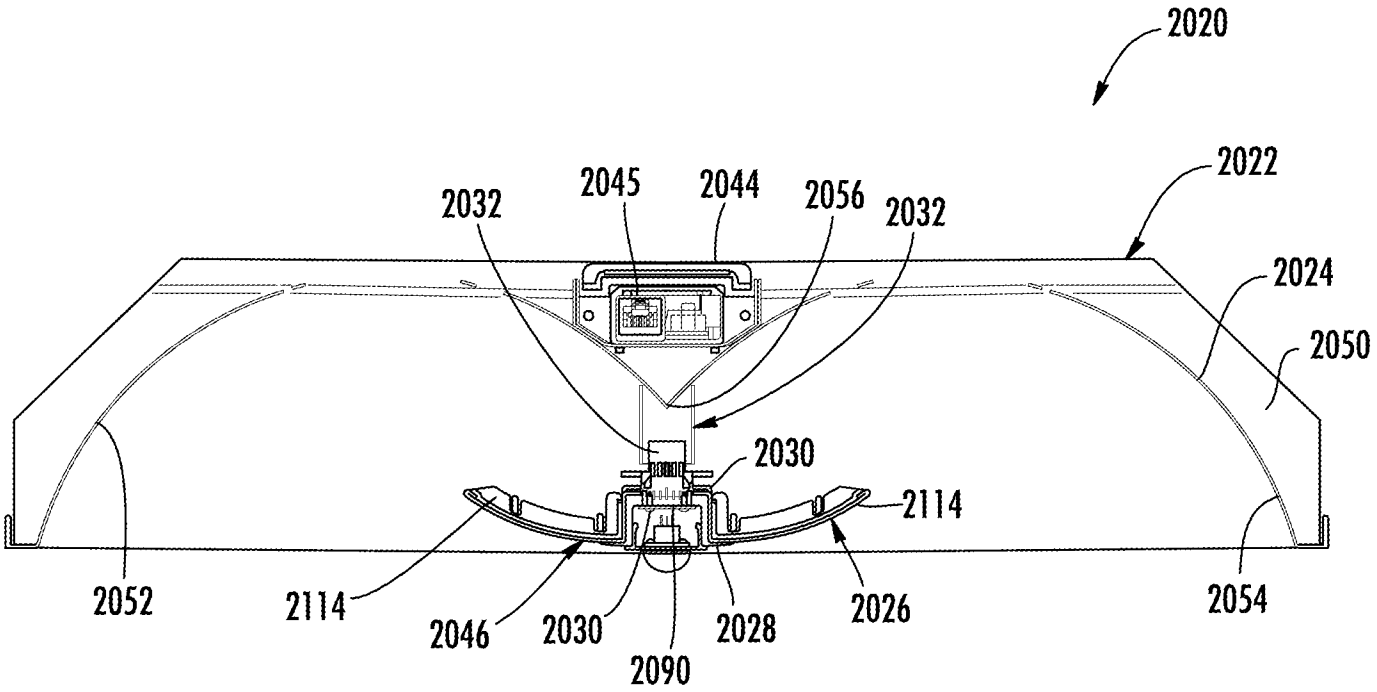
FIG. 28 is a cross-sectional view of the luminaire of FIG. 17.

In an embodiment, a cover 2118, FIG. 28, is attached to the rail 2028 to cover the sensor board 2040. In an embodiment, the cover 2118 includes a pair of legs 2120, 2122 which extend upwardly from a base wall 2124. The legs 2120, 2122 of the cover 2118 engage with the upright walls 2096, 2098 of the rail 2028. In an embodiment, the legs 2120, 2122 of the cover 2118 releasably engage with the upright walls 2096, 2098 of the rail 2028 and one of the legs 2120, 2122 and the upright walls 2096, 2098 have a protrusion and the other has a recess into which the protrusion seats. The cover 2118 can be released so that the sensor board 2040 can be serviced. The cover 2118 can have a variety of patterns/designs thereon and can be exchanged for different patterns/designs.

The LEDs 2038 on the light board 2036 can be controlled by a controller 118. The LEDs 2038 will typically include more than two LEDs but there is not a particular number that is required. In some embodiments, the LEDs 2038 may be of differing color temperatures. Such an assortment of colors enables many different lighting mixings to be provided by varying the mix and illumination level of different LED colors. The location of the controller 118 that adjusts the output and/or the lighting mixing of the LED array can vary depending on the configuration of the luminaire 2020 (or luminaire 1020).

The LEDs 2038 on the light board 2036 can be controlled by a controller 118. The LEDs 2038 will typically include more than two LEDs but there is not a particular number that is required. In some embodiments, the LEDs 2038 may be of differing color temperatures. Such an assortment enables many different lighting color temperatures to be provided by varying the mix and illumination levels of different LED colors. The location of the controller 118 that adjusts the output and/or the lighting effects of the LED array can vary depending on the configuration of the luminaire.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A luminaire comprising:

a housing with a reflector, the housing configured to be mounted in a ceiling, the housing supporting a first connector;

a light board diffuser assembly comprising a rail, a connector, a light board, and a diffuser, wherein the light board diffuser assembly is configured to be attached to and removed from the housing and the diffuser is aligned with the reflector when the light board diffuser assembly is attached to the housing;

wherein the rail includes a first side facing the reflector when the light board diffuser assembly is attached to the housing, and a second side opposite the first side, the rail including a first end and a second end, the rail including a second connector on the first end that is configured to mate with the first connector when the light board diffuser assembly is attached to the housing;

the light board is mounted on the first side of the rail, the light board supporting a plurality of light emitting diodes (LEDs), wherein the LEDs are thermally coupled to the rail and are configured to emit light into the reflector when the light board diffuser assembly is attached to the housing;

wherein the light board diffuser assembly is removable from the housing, and wherein the rail is removeable from the diffuser;

a controller configured to control output of the LEDs; and a sensor configured to provide feedback to the controller regarding conditions adjacent the luminaire so that the luminaire can provide a more intelligent illumination.

2. The luminaire of claim 1, wherein the plurality of LEDs comprise LEDs of at least two different color temperatures.

3. The luminaire of claim 2, wherein the luminaire is configured to provide different lighting mixing by varying the mix and illumination level of the LEDs of at least two different color temperatures.

4. The luminaire of claim 1, wherein the diffuser is releasably attached to the rail.

5. The luminaire of claim 1, wherein the housing has a slot therein, and the rail has a tab which extends outwardly therefrom and is configured to engage within the slot to further attach the rail to the housing.

6. The luminaire of claim 1, wherein multiple diffusers are provided and each can be coupled to the rail.

7. The luminaire of claim 6, wherein each diffuser has a plurality of perforations therein, the perforations being different in each diffuser.

8. The luminaire of claim 6, wherein each diffuser has a film extending over the perforations.

9. The luminaire of claim 1, wherein the luminaire is configured to operate via power received from an Ethernet cable providing power over Ethernet (PoE).

10. The luminaire of claim 1, where the LEDs indicate at least one of a pathway, an emergency situation, a diagnostic and an occupancy.

11. The luminaire of claim 1, where the controller is configured to convert a higher-level protocol to a lower-level protocol.

12. The luminaire of claim 1, where the light board diffuser assembly is removable from the controller without accessing the ceiling.

13. The luminaire of claim 1, wherein the sensor is configured to detect at least one item from the group consisting of ambient light, temperature, occupancy, motion, noise, air quality, and humidity.

* * * * *